US007997669B2

(12) United States Patent
Chikamoto et al.

(10) Patent No.: US 7,997,669 B2
(45) Date of Patent: Aug. 16, 2011

(54) INKJET RECORDING APPARATUS

(75) Inventors: Tadanobu Chikamoto, Nagoya (JP); Akira Shinoda, Obu (JP); Mikio Hirano, Obu (JP); Hiroshi Taira, Ichinomiya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 12/509,264

(22) Filed: Jul. 24, 2009

(65) Prior Publication Data

US 2010/0053240 A1 Mar. 4, 2010

(30) Foreign Application Priority Data

Aug. 28, 2008 (JP) ..... 2008-219204
Aug. 28, 2008 (JP) ..... 2008-219205
Aug. 28, 2008 (JP) ..... 2008-219206

(51) Int. Cl.
*B41J 29/38* (2006.01)

(52) U.S. Cl. ..... 347/6; 347/85

(58) Field of Classification Search ..... None
See application file for complete search history.

(56) References Cited

U.S. PATENT DOCUMENTS

2008/0018721 A1* 1/2008 Umeda ..... 347/87

FOREIGN PATENT DOCUMENTS

JP S48-76102 A 10/1973
JP S59-222357 A 12/1984
JP 2007-090639 A 4/2007
JP 2007-105994 A 4/2007
JP 2008-079428 A 4/2008

OTHER PUBLICATIONS

Machine translation of JP 2008-079428 A.*
Translation of JP 48-076102 A.*
Translation of JP 2008-079428 A.*
Japan Patent Office; Notification of Reason for Refusal in Japanese Patent Application No. 2008-219204 (counterpart to the above captioned US application) mailed Jul. 13, 2010.

* cited by examiner

*Primary Examiner* — Matthew Luu
*Assistant Examiner* — Justin Seo
(74) *Attorney, Agent, or Firm* — Baker Botts L.L.P.

(57) ABSTRACT

An inkjet recording apparatus including: (a) a recording head; (b) an ink supply source; (c) an ink supply conduit interconnecting the recording head and the ink supply source, such that the ink is supplied from the ink supply source to the recording head in an ink supplying direction; (d) a movable body disposed in the ink supply conduit and movable in the ink supply conduit; (e) a moving device configured to move the movable body in the ink supply conduit; and (f) a control device configured to control the moving device. The ink supply conduit includes a small-clearance defining portion in which a small clearance is to be defined between the movable body and an inner surface of the ink supply conduit when the movable body is being positioned in the small-clearance defining portion. The control device is configured to control the moving device, such that the movable body is moved from a first position located in the small-clearance defining portion, to a second position located in the small-clearance defining portion, whereby the ink within the small-clearance defining portion is caused to flow toward the recording head.

30 Claims, 23 Drawing Sheets

INKJET RECORDING APPARATUS

CROSS REFERENCE TO RELATED APPLICATION

This application claims priority from Japanese Patent Applications No. 2008-219204, No. 2008-219205 and No. 2008-219206, which are filed on Aug. 28, 2008, the disclosures of which are herein incorporated by references in their entireties.

BACKGROUND OF THE INVENTION

1. Field of the Invention

The present invention relates to an inkjet recording apparatus operable to record an image on a recording medium.

2. Discussion of Related Art

JP-2007-105994A discloses an inkjet recording apparatus in which ink is supplied from an ink tank to a recording head via an ink supply tube (see FIG. 1 of the Japanese Publication). In this inkjet recording apparatus, a quantitative pump is provided in a non-end portion of the ink supply tube, so that a predetermined amount of the ink can be forced to flow from the ink tank to the recording head, by activation of the quantitative pump. The quantitative pump is a plunger pump including a plunger which is introduced in a cylinder and which extends to a distal end portion of the cylinder. The predetermined amount of the ink is conveyed by rotation of the plunger about its axis, which is made by a drive unit such as a motor.

In the disclosed inkjet recording apparatus, the above-described plunger has an end portion that is exposed outside the cylinder. It is considered that a motor is connected to the exposed end portion of the plunger. It is further considered that there is a small clearance between an outer circumferential surface of the plunger and an inner circumferential surface of the cylinder, since the plunger has to be rotatable in the cylinder. Therefore, the clearance has to be sealed by a sealing member such as an O-ring, for avoiding leakage of the ink through the clearance. Due to rotation of the plunger, the sealing member is likely to be worn down, and the wear of the sealing member would problematically cause fragments of the worn sealing members, entrance of air through the sealed clearance and leakage of the ink through the sealed clearance.

SUMMARY OF THE INVENTION

The present invention was made in view of the background prior art discussed above. It is therefore an object of the invention to provide an inkjet recording apparatus which is capable of causing a predetermined amount of ink to flow toward a recording head while preventing entrance of air into an ink supply conduit and also leakage of the ink from the ink supply conduit.

This object may be achieved according to a principle of the invention, which provides an inkjet recording apparatus including: (a) a recording head configured to eject ink toward a recording medium; (b) an ink supply source; (c) an ink supply conduit interconnecting the recording head and the ink supply source, such that the ink is supplied from the ink supply source to the recording head in an ink supplying direction; (d) a movable body disposed in the ink supply conduit and movable in the ink supply conduit; (e) a moving device configured to move the movable body in the ink supply conduit; and (f) a control device configured to control the moving device, wherein the ink supply conduit includes a small-clearance defining portion in which a small clearance is to be defined between the movable body and an inner surface of the ink supply conduit when the movable body is being positioned in the small-clearance defining portion, and wherein the control device is configured to control the moving device, such that the movable body is moved from a first position located in the small-clearance defining portion, to a second position located in the small-clearance defining portion, whereby the ink within the small-clearance defining portion is caused to flow toward the recording head, the second position being located on a downstream side of the first position in the ink supplying direction.

In the present inkjet recording apparatus, the ink within the small-clearance defining portion, i.e., a predetermined amount of the ink can be supplied to the recording head, by simply moving the movable body from the first position to the second position. As discussed above in BACKGROUND OF THE INVENTION, for example, if the movable body includes an exposed portion exposed outside the ink supply conduit and the movable body is movable by a motor or a cylinder that is to connected to the exposed portion, a clearance between the ink supply conduit and the movable body is required to be sealed by a sealing member that is made of, for example, a rubber. However, due to movement of the movable body, the sealing member is likely to be worn down, and the wear of the sealing member would problematically cause fragments of the worn sealing members, entrance of air through the sealed clearance and leakage of the ink through the sealed clearance. On the other hand, in the present inkjet recording apparatus, it is possible to arrange such that the movable body is movable only within the ink supply conduit without any portion of the movable body being exposed outside the ink supply conduit. This arrangement eliminates necessity of provision of a sealing member, and makes it possible to prevent the above-described problems which would be caused by the wear of the sealing members.

BRIEF DESCRIPTION OF THE DRAWINGS

The above and other objects, features, advantages and technical and industrial significance of the present invention will be better understood by reading the following detailed description of presently preferred embodiments of the invention, when considered in connection with the accompanying drawings, in which.

DETAILED DESCRIPTION OF THE PREFERRED EMBODIMENT

Figure 1:
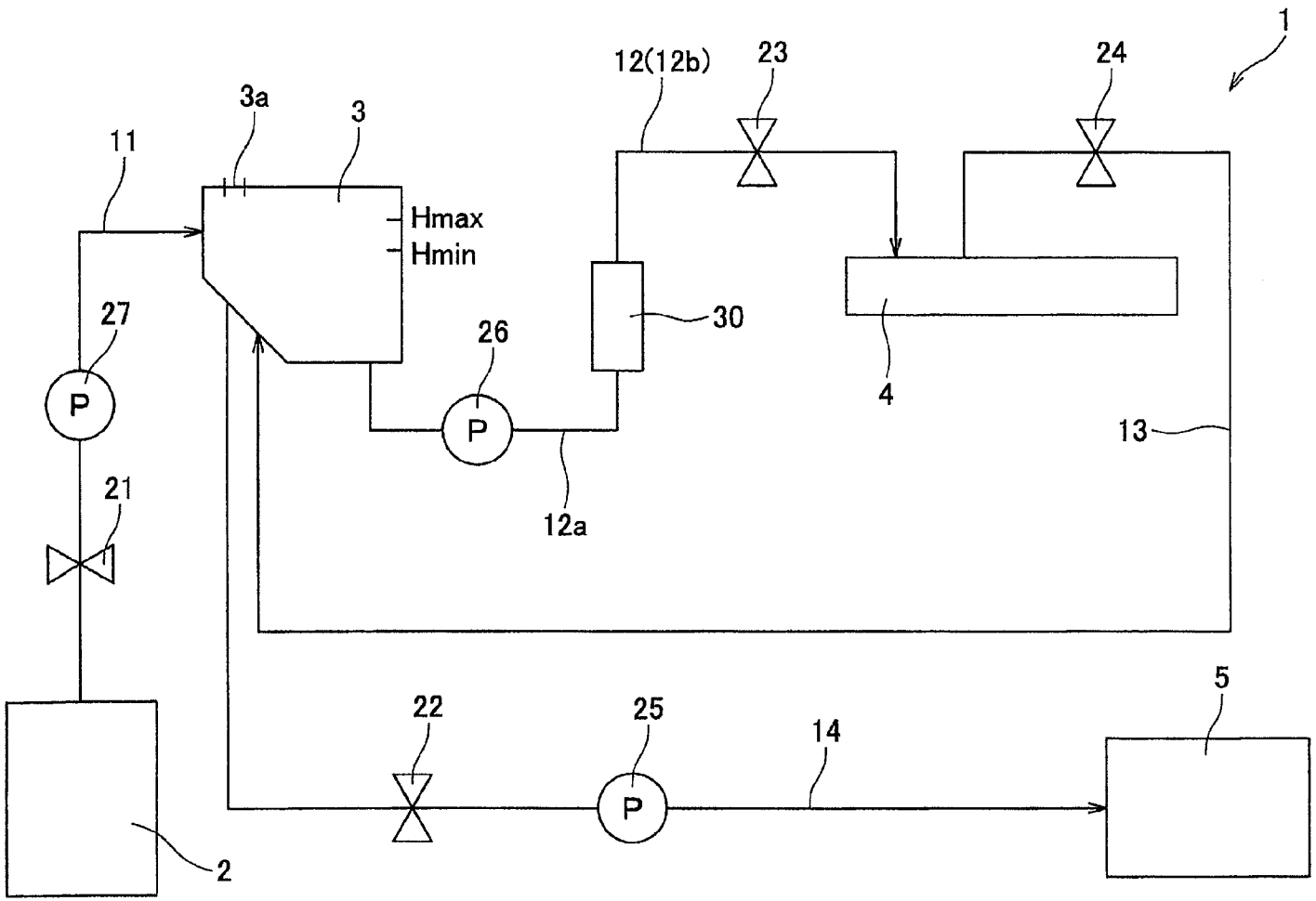
FIG. 1 is a view schematically showing an inkjet printer constructed according to a first embodiment of the invention.

Referring to the drawings, there will be described inkjet printers constructed according to embodiments of the invention.

First Embodiment

FIG. 1 shows an inkjet printer 1 which is constructed according to a first embodiment of the invention, and which is operable to eject ink toward a recording medium so as to record characters and images on the recording medium. As shown in FIG. 1, the inkjet printer 1 includes an ink cartridge 2 as an ink supply source, a subtank 3, an inkjet head 4 and a waste ink tank 5. The ink cartridge 2 is connected to the subtank 3 via a supply tube 11 having portions in which a valve 21 and a tube pump 27 are provided, so that the ink can be supplied to the subtank 3 from the ink cartridge 2.

The subtank 3 is provided to temporarily store therein the ink supplied from the ink cartridge 2 via the supply tube 11, and has an upper opening 3*a* through which its inner space is exposed to an atmosphere. A level of the ink stored in the subtank 3 is detected by, for example, an optical sensor (not shown). In the inkjet printer 1, the supply of the ink from the ink cartridge 2 is controlled based on the detected level of the stored ink, such that the level of the stored ink is held within a range between a maximum level Hmax and a minimum level Hmin.

The subtank 3 is connected to the waste ink tank 5 via a discharge tube 14 having portions in which a valve 22 and a tube pump 25 are provided. Since the inner space of the subtank 3 is exposed to the atmosphere, the ink stored in the subtank 3 is easily dried so that viscosity of the ink is likely to be increased as time passes. In the inkjet printer 1, when the ink viscosity has been considerably increased, a desired amount of the ink is discharged from the subtank 3 to the waste ink tank 5 via the discharge tube 14, and then the ink is supplied to the subtank 3 from the ink cartridge 2. Thus, the old ink is replaced by the new ink.

The subtank 3 is connected also to the inkjet head 4 via a supply tube 12 so that the ink can be supplied from the subtank 3 to the inkjet head 4 via the supply tube 12 in an ink supplying direction. The inkjet head 4 has a plurality of nozzles (not shown), and defines therein an ink passage that is configured to delivery the ink (which has been supplied from the subtank 3 via the supply tube 12) to the plurality of nozzles. The inkjet head 4 is configured to eject the ink through the nozzles to a recording sheet P when the inkjet head 4 is opposed to the recording sheet P which has been conveyed by a conveying mechanism (not shown).

A branch passage, which branches off from the ink passage defined in the inkjet head 4, is connected to the subtank 3 via a return tube 13 as an ink return conduit. The return tube 13 has a portion in which a valve 24 is provided.

In the inkjet printer 1, for example, when the ink supplied to the inkjet head 4 contains air bubbles, a recycle purge operation is carried out for returning the ink containing the air bubbles, to the subtank 3 via the return tube 13. Since the inner space of the subtank 3 is exposed to the atmosphere, the air bubbles contained in the ink are evacuated to the atmosphere. Thus, by carrying out the recycle purge operation, it is possible to prevent the ink containing the air bubbles, from reaching the nozzles of the inkjet head 4.

The supply tube 12 has portions in which a centrifugal pump 26, a quantitative ink supplier 30 and a valve 23 are provided, such that the centrifugal pump 26, quantitative ink supplier 30 and valve 23 are arranged in this order as viewed in the ink supplying direction. That is, the pump 26 and the valve 23 are provided on respective upstream and downstream sides of the ink supplier 30 in the ink supplying direction. The supply tube 12 is sectioned into an upstream-side tube portion 12*a* and a downstream-side tube portion 12*b* which are located on respective upstream and downstream sides of the ink supplier 30 in the ink supplying direction. In the present embodiment, the ink supplier 30 cooperates with the supply tubes 11, 12 to constitute an ink supply conduit defining an ink channel space that is surrounded by an inner surface of the ink supply conduit.

Figure 2:
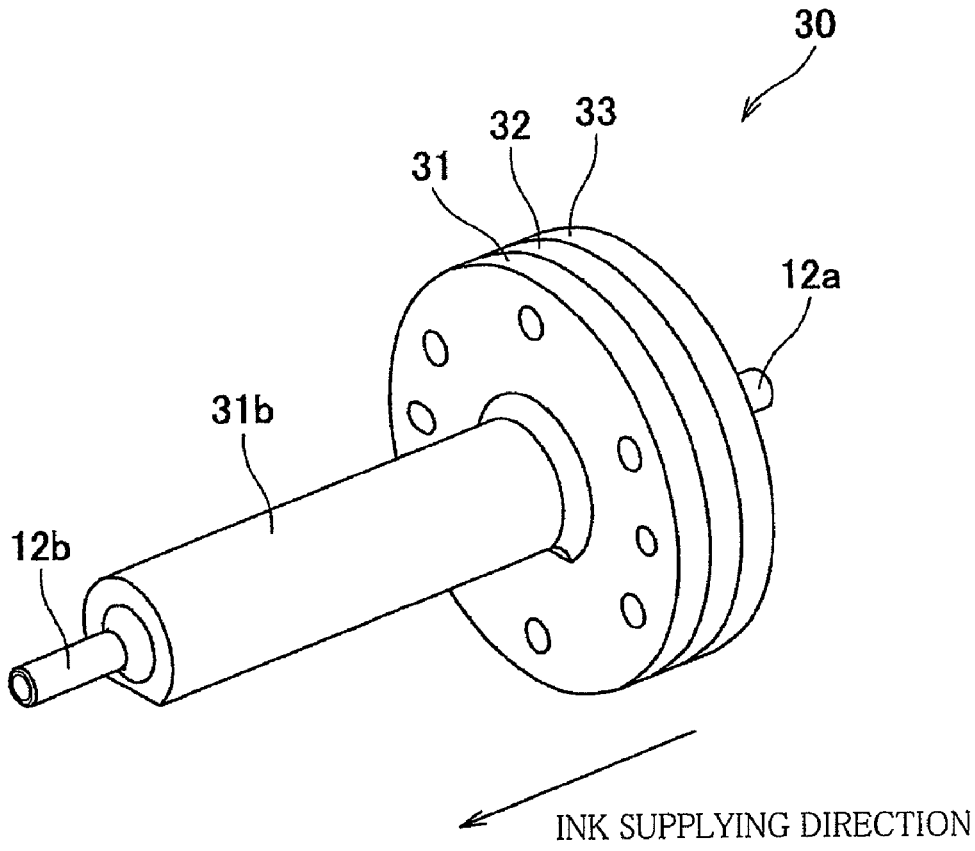
FIG. 2 is a perspective view showing a quantitative ink supplier.
Figure 3:
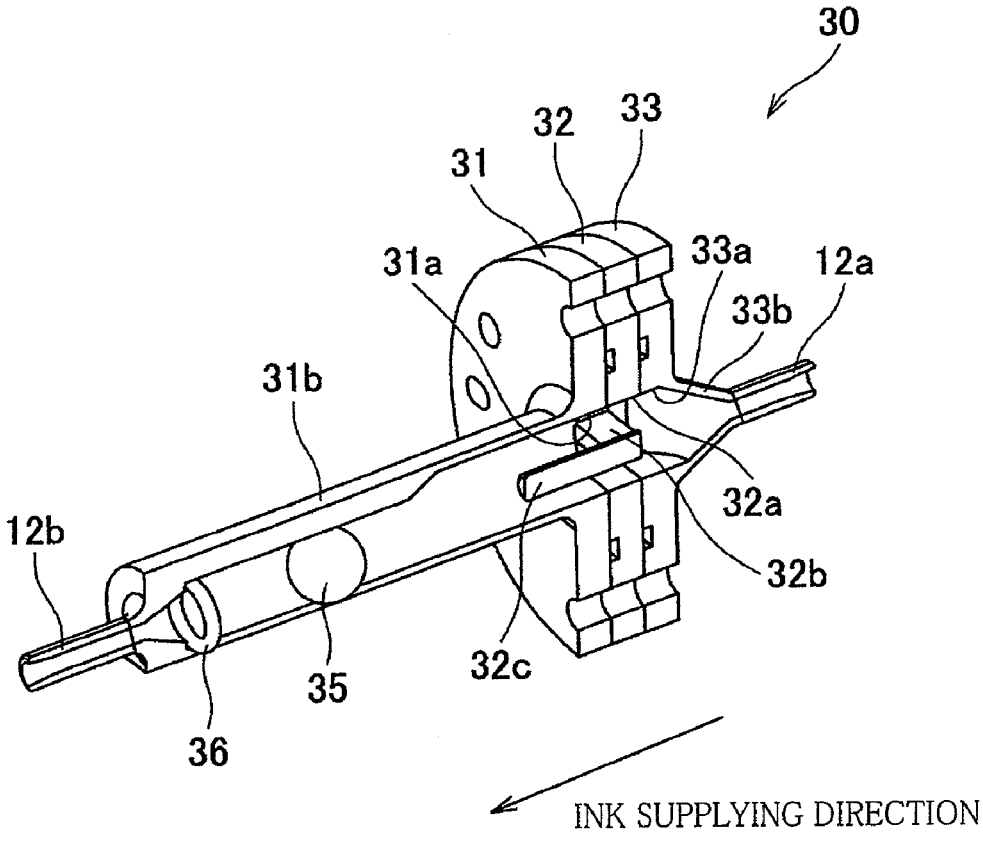
FIG. 3 is an axial cross sectional view of the quantitative ink supplier.
Figure 4:
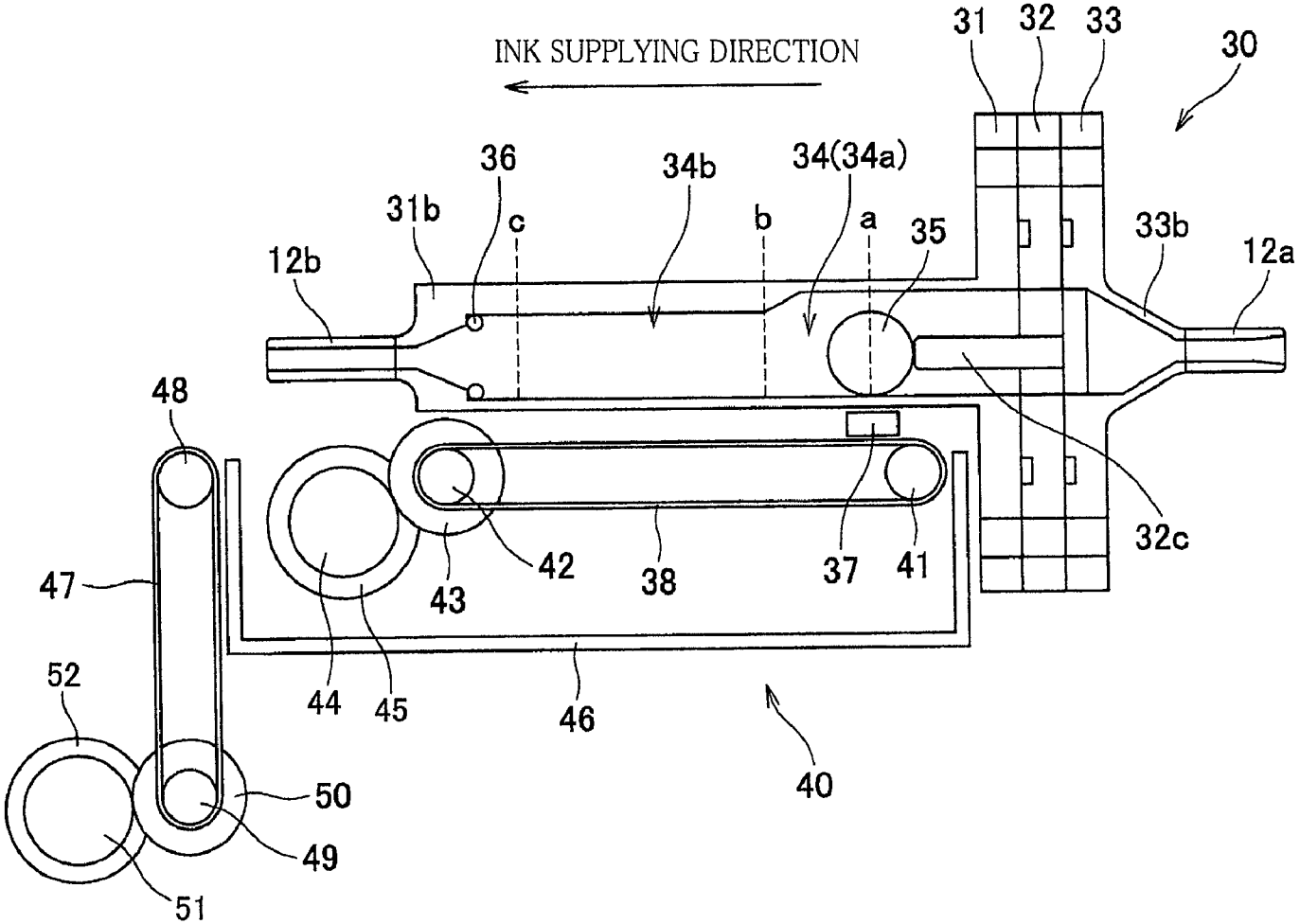
FIG. 4 is a view showing the quantitative ink supplier together with a magnet movement mechanism.

The quantitative ink supplier 30 will be described with reference to FIGS. 2 through 4. FIG. 2 is a perspective view of the quantitative ink supplier 30. FIG. 3 is an axial cross sectional view of the quantitative ink supplier 30. FIG. 4 is a view showing the quantitative ink supplier 30 together with a magnet movement mechanism.

As shown in FIGS. 2 through 4, the quantitative ink supplier 30 is constituted mainly by three disk-shaped flanges 31, 32, 33 that are superposed on each other. The flange 31 is located on a downstream side of the other two flanges 32, 33 in the ink supplying direction. A through-hole 31*a* having a circular cross section is formed at a center of the flange 31. The flange 31 has a tubular portion 31*b* extending from an outer peripheral portion of the through-hole 31*a* in the ink supplying direction.

The tubular portion 31*b* defines an inner space 34 having a large diameter portion, a transition portion, a small diameter portion and a tapered portion which are arranged in this order of description as viewed in the ink supplying direction, as shown in FIG. 4. The large diameter portion extends from an upstream end of the tubular portion 31*b* to an intermediate portion of the tubular portion 31*b*, and has a constant diameter. The transition portion interconnects the large diameter portion and the small diameter portion, and has a diameter that is gradually reduced in the ink supplying direction. The small diameter portion extends from the transition portion to a portion adjacent to a downstream end of the tubular portion 31*b*, and has a constant diameter that is smaller than the diameter of the large diameter portion. The large diameter portion and the small diameter portion have respective axes that are offset from each other such that the axis of the small diameter portion is located on a lower side of the axis of the large diameter portion and such that lower surfaces of the respective large diameter portion, transition portion and small diameter portion are substantially flush with one another. The tapered portion extends from the small diameter portion to the downstream end of the tubular portion 31*b*, and has a diameter that is gradually reduced in the ink supplying direction. The downstream end of the tubular portion 31*b* is connected to the downstream-side tube portion 12*b* of the supply tube 12. The inner space 34 of the tubular portion 31*b* includes the above-described tapered portion in which the diameter is reduced in the ink supplying direction. In other words, the ink supply conduit includes a tapered portion in which the inner surface of the ink supply conduit is tapered such that a cross sectional area of the ink channel space is reduced in the ink supplying direction. The tapered portion is located on a downstream side of the movement termination position c in the ink supplying direction. Owing to this tapered arrangement, air bubbles, if contained in the ink, can be effectively evacuated in the ink supplying direction, i.e., onto a downstream side of the tubular portion 31*b* in the ink supplying direction.

The flange 33 is located on an upstream side of the other two flanges 31, 32 in the ink supplying direction. A through-hole 33*a* having a circular cross section is formed at a center of the flange 33 (see FIG. 3). The flange 33 has a tapered tubular portion 33*b* extending from an outer peripheral portion of the through-hole 33*a* in a direction opposite to the ink supplying direction. The tapered tubular portion 33*b* has an outside diameter and an inside diameter that are reduced in the direction opposite to the ink supplying direction. An upper end of the tapered tubular portion 33*b* is connected to the upstream-side tube portion 12*a* of the supply tube 12.

The flange 32 is interposed between the other two flanges 31, 33 in the ink supplying direction. A through-hole 32*a* having a circular cross section is formed at a center of the flange 33 (see FIG. 3). The flange 32 has a radially projecting piece 32*b* that extends from a portion of an inner circumferential surface of the through-hole 32*a* toward a center of the hole 32*a* in a radial direction of the flange 32. The flange 32 further has an axially extending bar 32*c* that extends from a distal end portion of the radially projecting piece 32*b* to an intermediate portion of the large diameter portion of the inner space 34 in an axial direction of the flange 32. The radially projecting piece 32*b* has a thickness that is smaller than a radius of the hole 32*a*. The axially extending bar 32*c* has a diameter that is as large as the thickness of the projecting piece 32*b*. The upstream-side tube portion 12*a* and the downstream-side tube portion 12*b* of the supply tube 12 are held in communication with each other via the inner space 34 of the tubular portion 31*b*, the through-holes 31*a*, 32*a*, 33*a* of the respective flanges 31, 32, 33 and an inner space of the tapered tubular portion 33*b*.

As shown in FIG. 4, the inner space 34 of the tubular portion 31*b* is sectioned into an upstream-side space 34*a* and a downstream-side space 34*b* that are respectively located on an upstream side and a lower stream side of a movement start position b as a first position in the ink supplying direction. The movement start position b corresponds to a boundary between the above-described transition portion and small-diameter portion of the inner space 34. In the inner space 34 of the tubular portion 31*b*, there is disposed a spherical body 35 as a movable body which is made of a magnetic material (ferromagnetic material) such as iron and which is movable only within the tubular portion 31*b*. In the present embodiment, since the movable body is provided by the spherical body, the movable body can be smoothly moved inside the tubular portion 31*b* as a part of the supply tube 12, i.e., as a part of the ink supply conduit.

The spherical body 35 has a diameter, which permits a small clearance to be defined between the spherical body 35 and an inner surface of the tubular portion 31*b* when the spherical body 35 is being positioned in the downstream-side space 34*b* as a small-clearance defining portion. In the present embodiment, the small clearance is about 0.1 mm. In a downstream end portion of the above-described small diameter portion of the inner space 34, there is provided a sealing member in the form of an O-ring 36 that is made of an elastic material such as a rubber. The O-ring 36, which is thus provided in the downstream end portion of the small diameter portion of the inner space 34, is fitted in the inner surface of the tubular portion 31*b*.

The spherical body 35 can be brought into contact with a distal end of the axially extending bar 32*c* when being positioned in the upstream-side space 34*a*, namely, when being positioned in a waiting position a as a third position that corresponds to an upstream-side movement end position. The spherical body 35 can be moved from the waiting position a via the movement start position b to a movement termination position c as a second position that corresponds to a downstream-side movement end position. The spherical body 35 can be brought into contact with the O-ring 36 when being positioned in the movement termination position c. It is noted that, more precisely described, broken lines a, b, c in FIG. 4 indicate a position of a center of the spherical body 35 when the spherical body 35 is being positioned in the respective positions a, b, c.

When the spherical body 35 is being positioned in the waiting position a, an opening as a large clearance is defined between the spherical body 35 and the inner surface of the tubular portion 31*b*. This opening has a cross sectional area that is much larger than a cross sectional area of the above-described small clearance, which is defined between the spherical body 35 and the inner surface of the tubular portion 31*b* when the spherical body 35 is being positioned in the downstream-side space 34*b* as the small-clearance defining portion. Therefore, when the spherical body 35 is being positioned in the waiting position a, an ink-supply-source side portion and a recording-head side portion of the ink supply conduit, which are located on opposite sides of the spherical body 35 in the ink supplying direction, are held in communication with each other through the opening as the large clearance. Thus, the ink-supply-source side portion and recording-head side portion of the ink supply conduit can be held in communication with each other, by simply positioning the spherical body 35 in the waiting position a, without provision of a bypass conduit. The spherical body 35 is kept positioned in the waiting position a, when a printing operation, a recycle purge operation and a massive purge operation are carried out.

When the spherical body 35 has been moved from the waiting position a to the movement start position b, the clearance between the spherical body 35 and the inner surface of the tubular portion 31*b* becomes small so that it becomes difficult for the ink to flow from the ink-supply-source side portion of the ink supply conduit to the recording-head side portion of the ink supply conduit. When the spherical body 35 is moved from the movement start position b to the movement termination position c, a predetermined amount of the ink stored within the downstream-side space 34*b* as the small-clearance defining portion is forced to flow toward the inkjet head 4.

When the spherical body 35 has been moved to the movement termination position c, the spherical body 35 is brought into contact with the O-ring 36 so that a fluid tightness between the spherical body 35 and the inner surface of the tubular portion 31*b* is established by the O-ring 36, thereby reliably stopping flow of the ink toward the inkjet head 4. Thus, the ink can be caused to flow accurately by the predetermined amount toward the inkjet head 4, as a result of the movement of the spherical body 35 from the movement start position b to the movement termination position c in the inner space 34.

As shown in FIG. 4, a magnet 37 and a magnet movement mechanism 40 are provided outside the tubular portion 31*b*. The magnet 37 and the magnet movement mechanism 40 serve as an attracting portion and a moving portion of a moving device, respectively, which will be described later. The magnet movement mechanism 40 includes belts 38, 47, pulleys 41, 42, 48, 49, gears 43, 44, 50, 51, rotary motors 45, 52 and a tray 46.

The magnet 37 as the attracting portion is disposed in proximity to an outer surface of the tubular portion 31*b*, and is fixed to the endless belt 38. The belt 38 is stretched around the pulleys 41, 42 that are spaced apart from each other in a direction parallel to the ink supplying direction (i.e., leftward direction as seen in FIG. 4). The pulley 41 is positioned in substantially the same position as a distal end portion of the axially extending bar 32*c* in the ink supplying direction. In other words, the pulley 41 overlaps with the distal end portion of the extending bar 32*c* as seen in a vertical direction that is substantially perpendicular to the ink supplying direction. Meanwhile, the pulley 42 is located on a downstream side of the O-ring 36 in the ink supplying direction.

The gear 43 is fixed to an axial end portion of the pulley 42, and meshes with the gear 44 that is connected to the rotary motor 45. That is, when the rotary motor 45 is driven, the gear 44 is rotated and also the gear 43 meshing with the gear 44 is rotated, so that the belt 38 is caused to run as a result of rotation of the pulley 42 that is connected to the gear 43. With the running of the belt 38, the magnet 37 can be moved in directions parallel to the ink supplying direction. Thus, the magnet 37 is reciprocatable between two positions which correspond to the waiting position a and the movement termination position c.

The above-described magnet 37, belt 38, pulleys 41, 42, gears 43, 44 and rotary motor 45 are fixedly disposed in the tray 46 that is fixed to the endless belt 47. The belt 47 is stretched around the pulleys 48, 49 that are spaced apart from each other in a direction perpendicular to the ink supplying direction (i.e., vertical direction as seen in FIG. 4). The pulley 48 is positioned in substantially the same position as the pulleys 41, 42 in the vertical direction. In other words, the pulley 48 overlaps the pulleys 41, 42 as seen in the ink supplying direction. Meanwhile, the pulley 49 is located on a lower side of the pulley 48, namely, is located in a position that is more distant, than the pulley 48, from the tubular portion 31*b* in the vertical direction.

The gear 50 is fixed to an axial end portion of the pulley 49, and meshes with the gear 51 that is connected to the rotary motor 52. That is, when the rotary motor 52 is driven, the gear 51 is rotated and also the gear 50 meshing with the gear 51 is rotated, so that the belt 47 is caused to run as a result of rotation of the pulley 49 that is connected to the gear 50. With the running of the belt 47, the tray 46 together with the magnet 37, belt 38, pulleys 41, 42, gears 43, 44 and rotary motor 45 that are disposed in the tray 46 is moved in directions parallel to the vertical direction. Thus, owing to the magnet movement mechanism 40, the magnet 37 is reciprocatable in the directions parallel to the vertical direction as well as in the directions parallel to the ink supplying direction.

Figure 5:
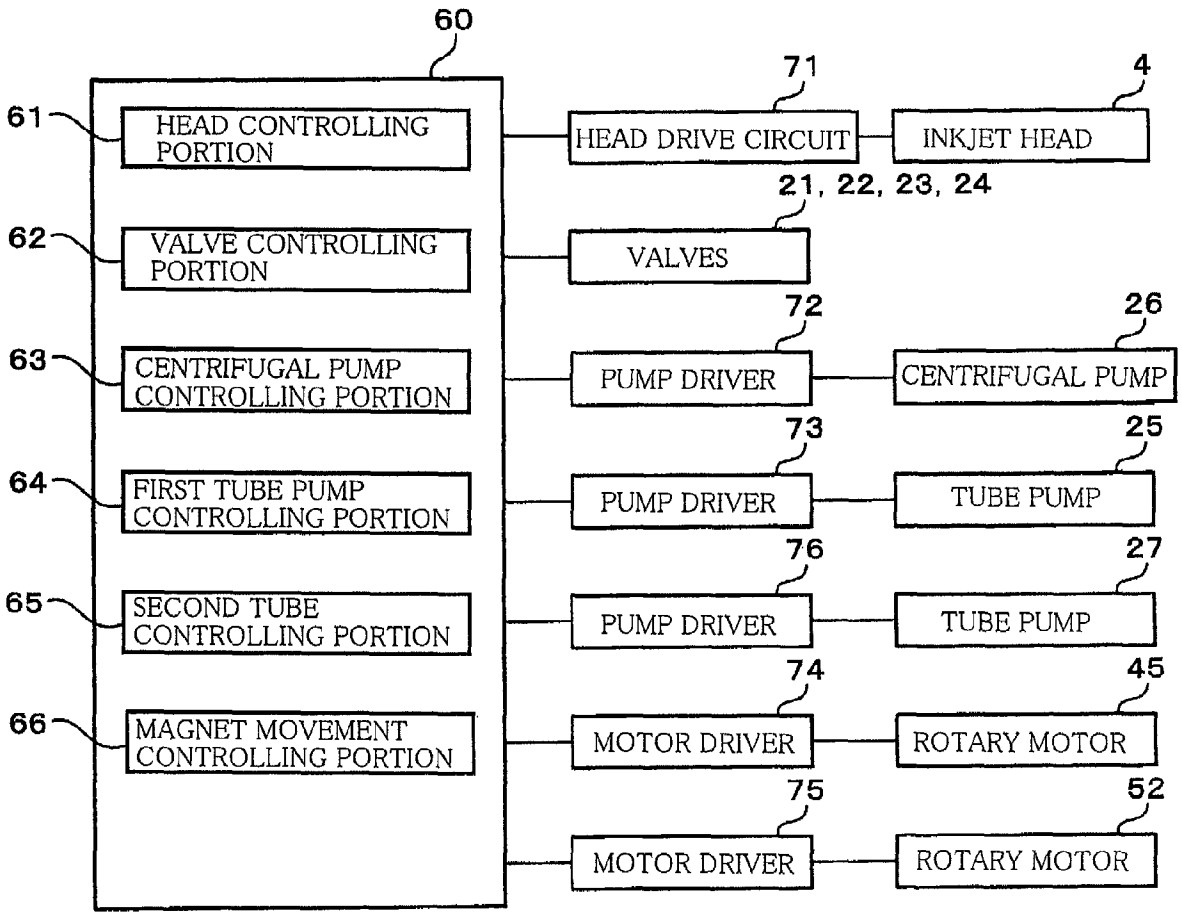
FIG. 5 is a block diagram showing a control arrangement in the inkjet printer constructed according to the first embodiment.

Referring next to FIG. 5 that is a block diagram, there will be described a control arrangement in the inkjet printer 1 that is constructed according to the first embodiment. The inkjet printer 1 includes a control device 60 that is principally constituted by CPU (Central Processing Unit), ROM (Read Only Memory) storing various control programs executed by the CPU and various data used in execution of the control programs, and RAM (Random Access Memory) for temporarily storing various data in execution of the control programs.

As shown in FIG. 5, the control device 50 includes a head controlling portion 61, a valve controlling portion 62, a centrifugal pump controlling portion 63, a first tube pump controlling portion 64, a second tube pump controlling portion 65 and a magnet movement controlling portion 66.

The head controlling portion 61 is configured, when the control device 60 receives print command signals from a personal computer (not shown), to control a head drive circuit 71 such that the ink is caused to be ejected from the inkjet head 4 for thereby performing a printing operation onto the sheet P. Operational states of the valves 21, 22, 23, centrifugal pump 26 and tube pump 25 during the printing operation will be described later.

The valve controlling portion 62 is configured to control the valves 21, 22, 23 such that each of the valves 21, 22, 23 is placed in a selected one of open and close states. The centrifugal pump controlling portion 63 is configured to control a pump driver 72 for driving the centrifugal pump 26. The first tube pump controlling portion 64 is configured to control a pump driver 73 for driving the tube pump 25. The second tube pump controlling portion 65 is configured to control a pump driver 76 for driving the tube pump 27.

The magnet movement controlling portion 66 is configured to control the motor drivers 74, 75 for driving the rotary motors 45, 52, such that the magnet 37 is movable in the directions parallel to the ink supplying direction and also in the directions parallel to the vertical direction, by causing the pulleys 42, 49 to be rotated and thereby causing the belts 38, 47 to run. The spherical body 35 disposed in the inner space 34 of the tubular portion 31*b* can be attracted by the magnet 35 as the attracting portion. Thus, when the magnet 37 is positioned in a position which is close to the spherical body 35 in the vertical direction and which is opposed to the spherical body 35 in the vertical direction, the spherical body 35 is attracted by the magnet 37 whereby the spherical body 35 is movable together with the magnet 37 in the directions parallel to the ink supplying direction. In the present embodiment, the magnet 37 and magnet movement mechanism 40 cooperate with each other to constitute a part of the moving device that is configured to move the spherical body 35 as the movable body by giving a motive force to the spherical body 35.

There will be next described an operation for supplying the ink from the ink cartridge 2 to the subtank 3. The ink stored in the subtank 3 is gradually reduced as a result of supply of the ink from the subtank 3 to the inkjet head 4. When a level of the ink stored in the subtank 3 has been lowered to a minimum height Hmin as a result of reduction of the ink stored in the subtank 3, the valve 21 is opened under control of the valve controlling portion 62, and the tube pump 27 is activated under control of the second tube controlling portion 65, whereby the ink is sucked from the ink cartridge 2 so as to be supplied to the subtank 3. Then, when the level of the ink stored in the subtank 3 has been elevated to a maximum height Hmax as a result of supply of the ink to the subtank 3, the valve 21 is closed under control of the valve controlling portion 62, and activation of the tube pump 27 is stopped under control of the second tube controlling portion 65, whereby the supply of the ink from the ink cartridge 2 to the subtank 3 is stopped. Thus, the level of the ink stored in the subtank 3 is held within a certain range.

There will be next described an operation for discharging the ink from the subtank 3. The valve controlling portion 62 controls the valves 22, 23, 24 such that the valve 22 is opened while the valves 23, 24 are closed. Meanwhile, the tube pump 25 is activated under control of the first tube pump controlling portion 64, whereby the ink is sucked from the subtank 3 so as to be discharged to the waste ink tank 5 via the discharge tube 14. When a predetermined amount of the ink has been discharged from the subtank 3, the valve 22 is closed under control of the valve controlling portion 62, and activation of the tube pump 25 is stopped under control of the first tube controlling portion 64. Thereafter, the above-described ink supplying operation is carried out for supplying new ink to the subtank 3 from the ink cartridge 2.

Figure 6:
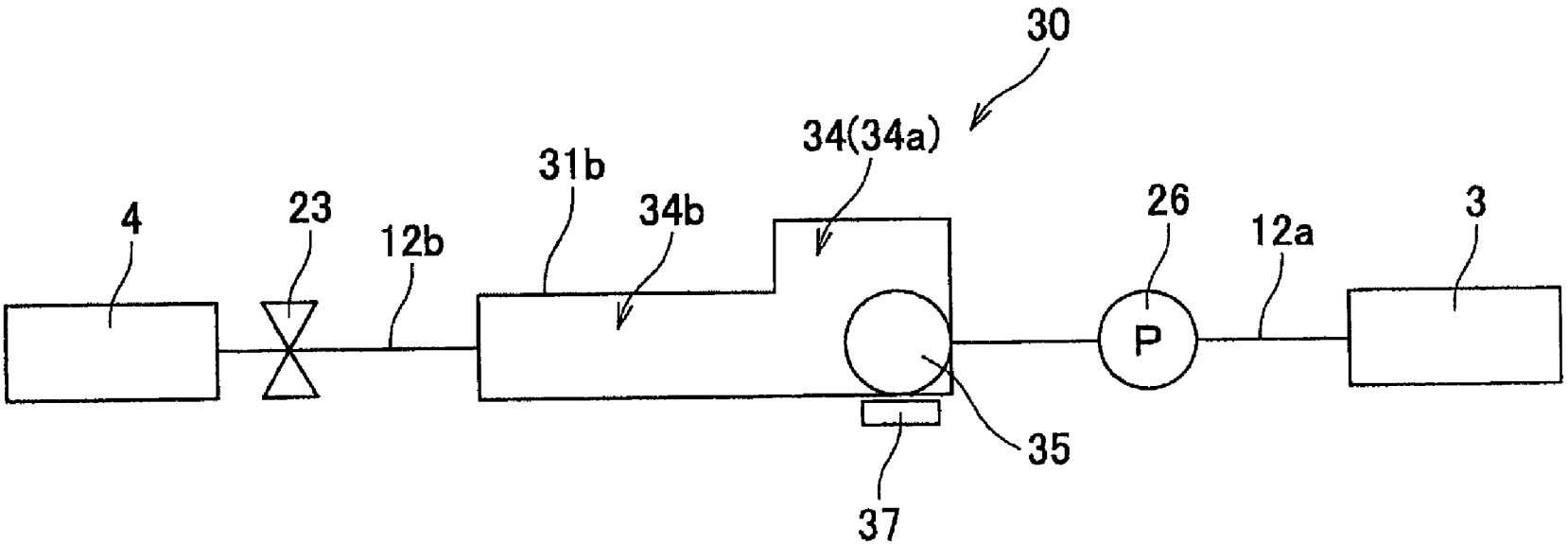
FIG. 6 is a view showing the quantitative ink supplier together with an inkjet head and a subtank that are connected to the quantitative ink supplier, in a stage in which a spherical body is positioned in a waiting position (third position)

There will be described the printing operation that is performed onto the sheet P. FIG. 6 shows a stage in which the spherical body 35 is positioned in the waiting position. In FIG. 6, the quantitative ink supplier 30 is illustrated in a simplified manner, and the magnet movement mechanism 40 is not illustrated.

During the printing operation, the spherical body 35 is kept positioned in the waiting position that is located in the upstream-side space 34*a*. In this instance, the spherical body 35 is attracted by the magnet 37. Therefore, as long as the magnet 37 is not moved, the spherical body 35 is not moved and is fixed in the waiting position. Further, during the printing operation, the valve controlling portion 62 controls the valves 21, 22, 23, 24 (see FIG. 1) such that the valves 21, 22, 24 are closed while only the valve 23 is opened. Meanwhile, activation of the tube pump 25 is stopped under control of the first tube pump controlling portion 64, and activation of the centrifugal pump 26 is stopped under control of the centrifugal pump controlling portion 63. With the valves 21, 22, 23, 24 and the pumps 25, 26 being thus controlled to be placed in their operational states, the head drive circuit 71 is controlled by the head controlling portion 61 such that the printing operation is carried out in the inkjet printer 1. The inkjet head 4 includes an actuator (not shown) which is actuated to establish a pressure difference in the supply tube 12 interconnecting the subtank 3 and the inkjet head 4. Owing to the pressure difference established in the supply tube 12, the ink stored in the subtank 3 is caused to pass through the upstream-side tube portion 12*a*, upstream-side space 34*a*, downstream-side space 34*b* and downstream-side tube portion 12*b* in this order of description, and to be supplied to the inkjet head 4 so as to be eventually ejected from the inkjet head 4.

Figure 7:
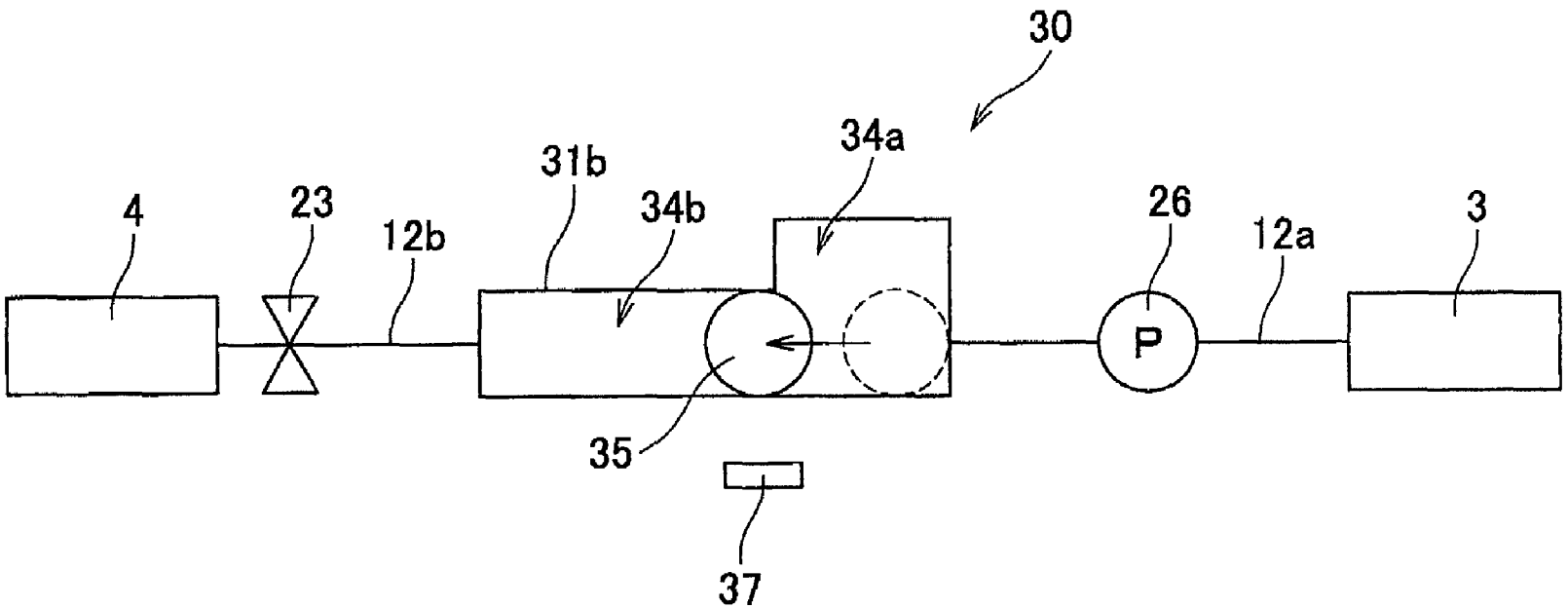
FIG. 7 is a view showing the quantitative ink supplier together with the inkjet head and the subtank, in a stage in which the spherical body has been moved from the waiting position to a first position.
Figure 8:
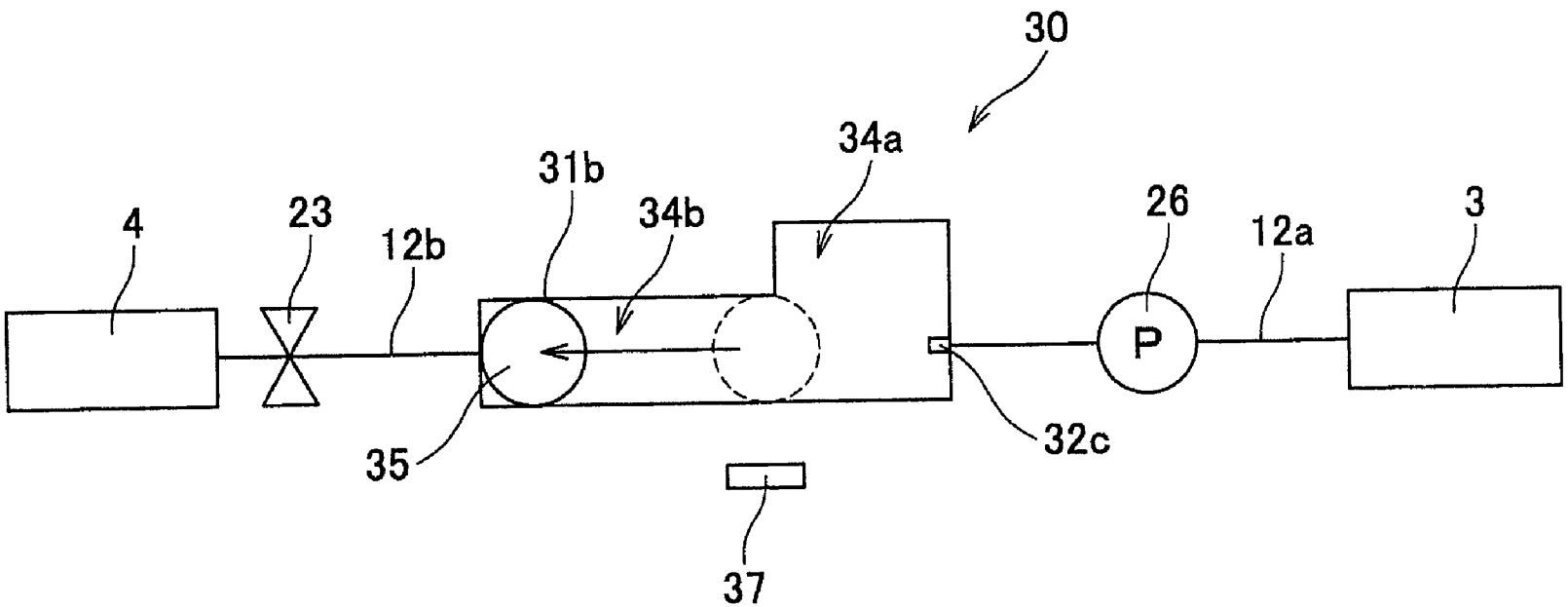
FIG. 8 is a view showing the quantitative ink supplier together with the inkjet head and the subtank, in a stage in which the spherical body has been moved from the first position to a second position.

There will be described a quantitative purge operation that is carried out, for example, when the inkjet head 4 suffers from clogging of the nozzles that causes failure in the ink ejection, so as to cause a predetermined amount of the ink to be ejected through the nozzles, for thereby recovering from the ink ejection failure. FIG. 7 shows a stage in which the spherical body 35 is positioned in the movement start position. FIG. 8 shows a stage in which the spherical body 35 is positioned in the movement termination position. In FIGS. 7 and 8, the quantitative ink supplier 30 is illustrated in a simplified manner, and the magnet movement mechanism 40 is not illustrated.

During the quantitative purge operation, the valve controlling portion 62 controls the valves 21, 22, 23, 24 (see FIG. 1) such that the valves 21, 22, 24 are closed while only the valve 23 is opened. In an inkjet printer which is not equipped with the quantitative ink supplier 30, magnet 37 and magnet movement mechanism 40, the quantitative purge operation is carried out by activation of a pump. However, among such printers in each of which the quantitative purge operation is carried out by activation of the pump, there would be a difference with respect to an amount of the ink that is ejected through the nozzles at a time, even if the pumps of the respective printers are activated equally to each other. This difference of the ink ejection amount among the printers is due to a difference among the printers with respect to ink density and ink flow resistance which are likely to be easily changed depending on temperature and humidity in each printer. Further, where a plurality of different kinds of inks can be ejected in such a printer, there would be a difference among the different kinds of inks with respect to an amount of the ink that is ejected through the nozzles at a time, even if the pump is activated equally for ejecting the different kinds of inks. This difference of the ink ejection amount among the inks is due to a difference among the inks with respect to the viscosity. It might be possible to avoid shortage of the ink ejection amount, by activating the pump by an amount larger than a fundamentally necessary amount. However, this arrangement leads to an unnecessary increase in consumption of the ink.

JP-2007-90639A discloses an arrangement in which a pressure sensor is provided in an ink supply tube so as to detect pressure of the ink in the ink supply tube during activation of a pump. In this arrangement, an amount of the activation of the pump is controlled depending on the detected pressure, such that an amount of ink ejection is kept constant. However, this arrangement leads to increase in manufacturing cost.

JP-2007-105994A discloses an arrangement in which a quantitative pump is provided in a non-end portion of an ink supply tube, so that a predetermined amount of the ink can be forced to flow from an ink tank to a recording head, by activation of the quantitative pump. The quantitative pump is a plunger pump including a plunger which is introduced in a cylinder and which extends to a distal end portion of the cylinder. The predetermined amount of the ink is conveyed by rotation of the plunger about its axis, which is made by a drive unit such as a motor.

In the above arrangement disclosed in JP-2007-105994A, the plunger has an end portion that is exposed outside the cylinder. It is considered that a motor is connected to the exposed end portion of the plunger. It is further considered that there is a small clearance between an outer circumferential surface of the plunger and an inner circumferential surface of the cylinder, since the plunger has to be rotatable in the cylinder. Therefore, the clearance has to be sealed by a sealing member such as an O-ring, for avoiding leakage of the ink through the clearance. Due to rotation of the plunger, the sealing member is likely to be worn down, and the wear of the sealing member would problematically cause fragments of the worn sealing members, entrance of air through the sealed clearance and leakage of the ink through the sealed clearance.

On the other hand, in the present inkjet printer 1, prior to the quantitative purge operation, the magnet 37 is first positioned in a position which is close to the tubular portion 31*b* in the vertical direction and which is opposed to the waiting position in the vertical direction, as shown in FIG. 6, and is then moved by activation of the rotary motor 45 under control of the magnet movement controlling portion 66 such that the spherical body 35 is moved from the waiting position to the movement start position. When the spherical body 35 has been moved to the movement start position, the magnet 37 is vertically moved in a direction away from the tubular portion 31*b*, as shown in FIG. 7, by activation of the rotary motor 52 under control of the magnet movement controlling portion 66, whereby the spherical body 35 is released from a magnetic force of the magnet 37.

Then, the quantitative purge operation is carried out by activation of the centrifugal pump 26 under control of the centrifugal pump controlling portion 63. That is, the spherical body 35 is forced, by the activation of the centrifugal pump 26, in the ink supplying direction, so as to be moved from the movement start position to the movement termination position. During the movement of the spherical body 35 from the movement start position to the movement termination position, the ink flows very little via the above-described small clearance between the spherical body 35 and the inner surface of the tubular portion 31*b*, so that a predetermined amount of the ink stored within the downstream-side space 34*b* as the small-clearance defining portion is forced to flow toward the inkjet head 4. In this instance, since the valve 24 is closed (see FIG. 1), the predetermined amount of the ink is forced to be ejected through the nozzles of the inkjet head 4.

The spherical body 35 is disposed in the inner space 34 of the tubular portion 31*b* as a part of the supply tube 12, and is movable only within the inner space 34 without any portion of the spherical body 35 being exposed outside the tubular portion 31*b*. This arrangement advantageously eliminates necessity of provision of a sealing member, and makes it possible to prevent the above-described problems which would be caused by wear of the sealing members and also to easily convey a predetermined amount of the ink to the inkjet head 4. That is, in the present embodiment, the centrifugal pump 26 also constitutes a part of the moving device that is configured to move the spherical body 35 as the movable body.

The centrifugal pump 26 as a part of the moving device is a pump that is other than a positive-displacement pump. Therefore, if the activation of the centrifugal pump 26 is continued even after the spherical body 35 has been moved to the movement termination position, it is possible to prevent increase of the pressure in the ink-supply-source side portion of the ink supply conduit, i.e., in a portion of the ink supply conduit which is located on an upstream side of the spherical body 35 in the ink supplying direction, namely, which is located on one of opposite sides of the spherical body 35 that is close to the spherical body 26. It is noted that the pump as the part of the moving device does not necessarily have to be a centrifugal pump as long as being a non-positive-displacement pump. It is further noted that there may be provided a sensor capable of detecting that the spherical body 35 has been moved to the movement termination position so that the activation of the pump can be stopped when the spherical body 35 has been moved to the movement termination position. In this modified arrangement, the pump does not necessarily have to be a non-positive-displacement pump but may be a positive-displacement pump.

After the quantitative purge operation, while the activation of the centrifugal pump 26 is being stopped under control of the centrifugal pump controlling portion 63, the rotational motor 45 is driven by the magnet movement controlling portion 66 such that the magnet 37 is moved to substantially the same position as the spherical body 35 in the ink supplying direction, namely, such that the magnet 37 is moved to a position overlapping with the spherical body 35 as seen in the vertical direction that is substantially perpendicular to the ink supplying direction. Then, the rotational motor 52 is driven by the magnet movement controlling portion 66 such that the magnet 37 is moved upwardly toward the flange 31 so as to attract the spherical body 35. Then, the rotational motor 45 is driven by the magnet movement controlling portion 66 such that the magnet 37 is moved from a position opposed to the movement termination position, to a position opposed to the waiting position, for thereby moving the spherical body 35 from the movement termination position to the waiting position.

There will be described the recycle purge operation that is carried out for returning the ink containing the air bubbles, to the subtank 3. During the recycle purge operation, the valve controlling portion 62 controls the valves 21, 22, 23, 24 such that the valves 21, 22 are closed while the valves 23, 24 are opened.

Further, during the recycle purge operation, the spherical body 35 is kept positioned in the waiting position that is located in the upstream-side space 34*a*. In this instance, since the spherical body 35 is attracted by the magnet 37, the spherical body 35 is not moved and is fixed in the waiting position as long as the magnet 37 is not moved. Then, the centrifugal pump 26 is driven by the centrifugal pump controlling portion 63 such that the ink within the supply tube 12 is forced to flow to the inkjet head 4. The ink flowing into the inkjet head 4 is caused to flow into the branch passage connected to the return tube 13 that is provided with the valve 24, since a flow resistance in the branch passage is reduced by opening of the valve 24 so as to be lower than that in the main ink passage connected to the nozzles. Thus, the ink is returned to the subtank 3 via the return tube 13.

There will be described a massive purge operation that is carried out when the nozzles have to be purged by a larger amount of the ink. As described above, the quantitative purge operation is carried out in case of failure in the ink ejection. However, there is a case where a degree of the ink ejection failure is so serious that the ink ejection failure cannot be sufficiently recovered by the quantitative purge operation, namely, by causing the predetermined amount of the ink within the downstream-side space 34*b* to be ejected through nozzles. In such a case, the massive purge operation is carried out whereby the nozzles are purged by a larger amount of the ink than in the quantitative purge operation. During the massive purge operation, the valve controlling portion 62 controls the valves 21, 22, 23, 24 such that the valves 21, 22, 24 are closed while only the valve 23 is opened.

Further, during the recycle purge operation, the spherical body 35 is kept positioned in the waiting position that is located in the upstream-side space 34*a*. In this instance, since the spherical body 35 is attracted by the magnet 37, the spherical body 35 is not moved and is fixed in the waiting position as long as the magnet 37 is not moved. Then, the centrifugal pump 26 is driven by the centrifugal pump controlling portion 63 such that the ink within the supply tube 12 is forced to flow to the inkjet head 4. The ink flowing into the inkjet head 4 is caused to flow into the main ink passage connected to the nozzles, since the valve 24 provided in the branch passage is closed. Thus, a large amount of the ink is ejected through the nozzles of the inkjet head 4.

As described above, in the present inkjet printer 1, in case of the quantitative purge operation and other cases where a predetermined amount of the ink has to be supplied to the inkjet head 4, the spherical body 35 is moved from the movement start position to the movement termination position, for thereby causing the ink to flow toward the inkjet head 4. Further, in the present inkjet printer 1, in case of the recycle purge operation, case of massive purge operation and other cases where the ink has to be supplied to the inkjet head 4 by an amount larger than the predetermined amount, the ink is caused to flow toward the inkjet head 4 by activation of the centrifugal pump 26 while the spherical body 35 is kept positioned in the waiting position.

While the inkjet printer 1 according to the first embodiment has been described, the inkjet printer 1 may be modified as needed. For example, in the above-described first embodiment, the spherical body 35 is moved from the movement start position to the movement termination position, by activation of the centrifugal pump 26. However, the spherical body 35 may be moved from the movement start position to the movement termination position, by moving the magnet 37 from a position opposed to the movement start position, to a position opposed to the movement termination position.

Further, in the first embodiment, the spherical body 35 as the movable body is made of a magnetic material while the attracting portion of the moving device is made of a magnet. However, it is possible to modify such that the spherical body is made of a magnet while the attracting portion of the moving device is made of a magnetic material or a ferromagnetic material.

Further, while the movable body is the spherical body in the first embodiment, the movable body does not necessarily have to be the spherical body but may be a disk-shaped body or otherwise shaped body as long as a small clearance can be defined between the movable body and the inner surface of the tubular portion 31*b* when the movable body is being positioned in the downstream-side space 34*b*.

Figure 9A:
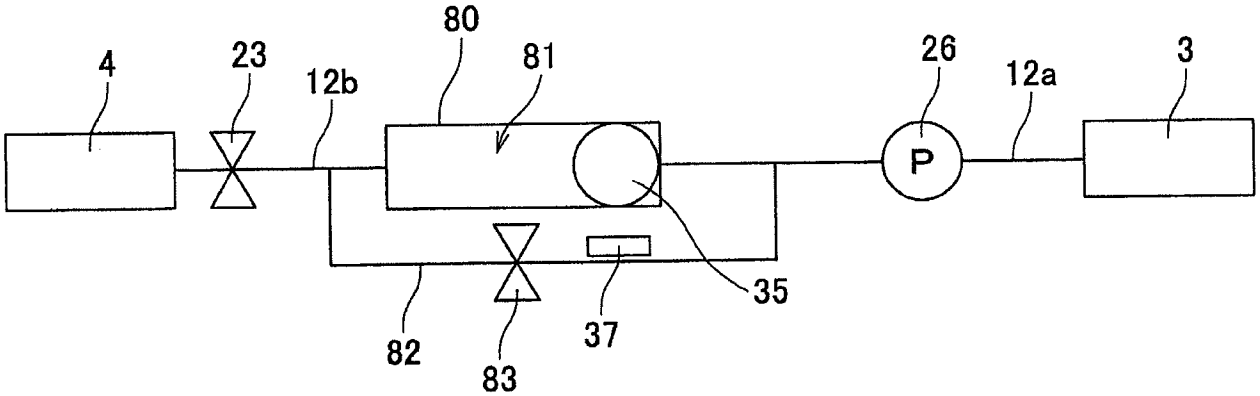
FIGS. 9A and 9B are views showing modifications of the first embodiment in each of which a bypass tube is provided in the quantitative ink supplier.

Further, in the first embodiment, when the spherical body 35 is being positioned in the waiting position a, the ink-supply-source side portion and the recording-head side portion of the ink supply conduit, which are located on respective upstream and downstream sides of the spherical body 35 in the ink supplying direction, are held in communication with each other through the opening as the large clearance which is defined in the upstream-side space 34*a*, as shown in FIG. 6. However, the upstream-side space 34*a* may be eliminated so that only an inner space 81 corresponding to the above-described downstream-side space 34*b* may be provided in a tubular portion 80, as shown in FIG. 9A. In this modification of the embodiment, a bypass tube 82 as a bypass conduit is provided to bypass the inner space 80 and to interconnect two interconnected portions of the ink supply conduit, such that one of the two interconnected portions is located between the centrifugal pump 26 and the tubular portion 80 while the other of the two interconnected portions is located between the valve 23 and the tubular portion 80. A valve 83 is provided in a non-end portion of the bypass tube 82.

Figure 9B:
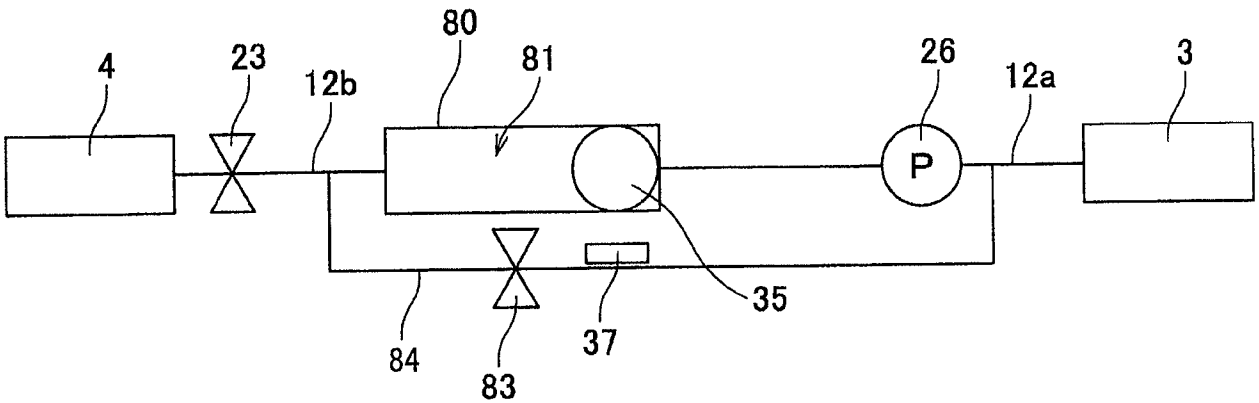

In the modification shown in FIG. 9A, an upstream end position within the inner space 81 of the tubular portion 80 serves as the waiting position as well as the movement start position while a downstream end position within the inner space 81 serves as the movement termination position. During the printing operation, the valves 23, 83 are opened under control of the valve controlling portion 62, and the head drive circuit 71 is controlled by the head controlling portion 61 such that the ink is supplied from the subtank 3 toward the inkjet head 4 via the bypass tube 82. During the recycle purge operation and the massive purge operation, the centrifugal pump 26 is driven under control of the centrifugal pump controlling portion 63 such that the ink is supplied from the subtank 3 toward the inkjet head 4 via the bypass tube 82. During the quantitative purge operation, while the valves 23, 83 are opened and closed, respectively, under control of the valve controlling portion 62, the centrifugal pump 26 is activated under control of the centrifugal pump controlling portion 63 for thereby moving the spherical body 35 from the movement start position to the movement termination position, whereby a predetermined amount of the ink stored within the inner space 81 as the small-clearance defining portion is forced to flow toward the inkjet head 4, as in the above-described first embodiment. It is noted that, as shown in FIG. 9B, the bypass conduit may be provided by a bypass tube 84 which is different from the above-described bypass tube 82 in that one of the two interconnected portions is located between the centrifugal pump 26 and the subtank 3.

Figure 10:
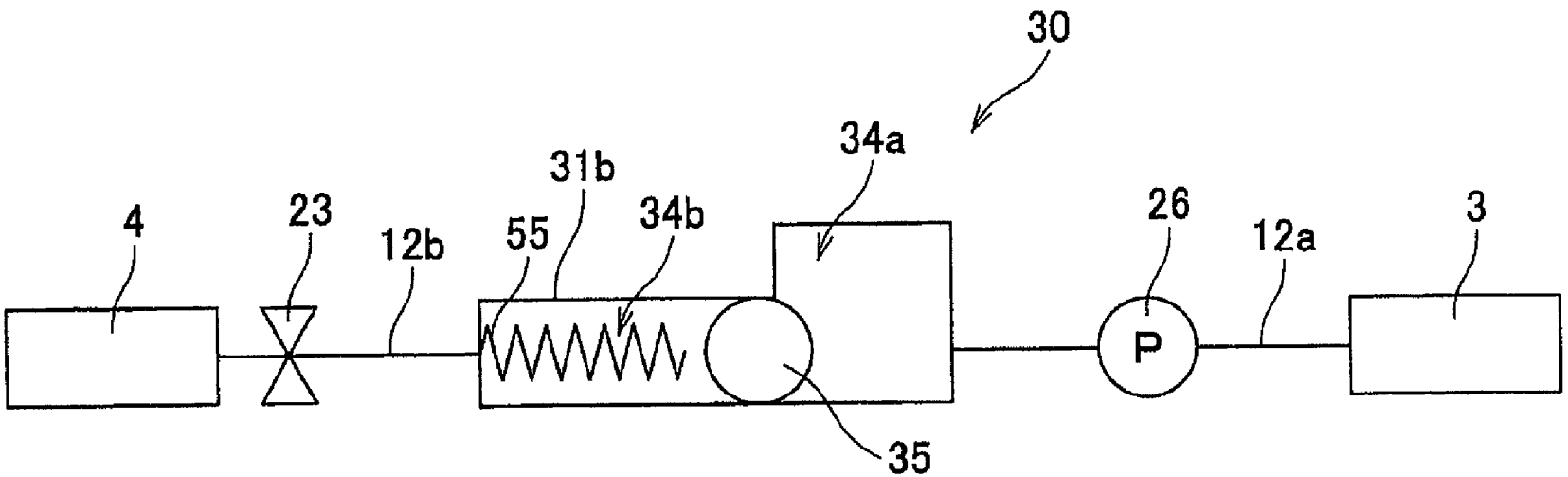
FIG. 10 is a view showing another modification of the first embodiment in which a spring is provided in the quantitative ink supplier.

Further, as shown in FIG. 10, the spherical body 35 may be moved from the movement termination position to the movement start position by a spring 55 as an elastic body, rather than by the magnet 37. In the modification shown in FIG. 10, the spring 55 is disposed in the downstream-side space 34*b* so as to be located on a downstream side of the spherical body 35. When the spherical body 35 is being positioned in the movement termination position, the spring 55 is elastically deformed or compressed by the spherical body 35. When the activation of the centrifugal pump 26 is stopped, the spherical body 35 is moved back from the movement termination position to the movement start position, owing to a restoring force of the spring 55.

Further, the first embodiment may be modified such that the tubular portion 31*b* extends in a vertically upward direction rather than in a horizontal direction, so that the spherical body 35 is moved from the waiting position to the movement termination position via the movement start position, by causing the spherical body 35 to be moved in the vertically upward direction. In this modification, the spherical body 35 has a specific gravity that is larger than a specific gravity of the ink, whereby the spherical body 35 can be moved, owing to a self-weight of the spherical body 35, from the movement termination position to the waiting position via the movement start position. It is noted that, in this modification, the tubular portion 31*b* does not necessarily have to extend precisely in an upright direction, but may extend in a diagonal direction as long as the diagonal direction includes a component parallel to the upright direction.

Further, in the above-described first embodiment, the O-ring 36 is provided in the downstream end portion of the above-described small diameter portion of the inner space 34 which is contiguous to the tapered portion of the inner space 34, as shown in FIG. 4. However, the provision of the O-ring 36 may be replaced by a modified arrangement in which an entire surface of the spherical body 35 is covered with a rubber or other elastic material having a small thickness, so that the sealing member is provided by the rubber covering the spherical body 35. In this modified arrangement, too, when the spherical body 35 is being positioned in the movement termination position, a fluid tightness between the spherical body 35 and the inner surface of the tubular portion 31*b* is established by the rubber covering the spherical body 35, thereby reliably stopping flow of the ink toward the inkjet head 4. Thus, the ink can be caused to flow accurately by the predetermined amount toward the inkjet head 4, as a result of the movement of the spherical body 35 from the movement start position to the movement termination position.

Figure 11:
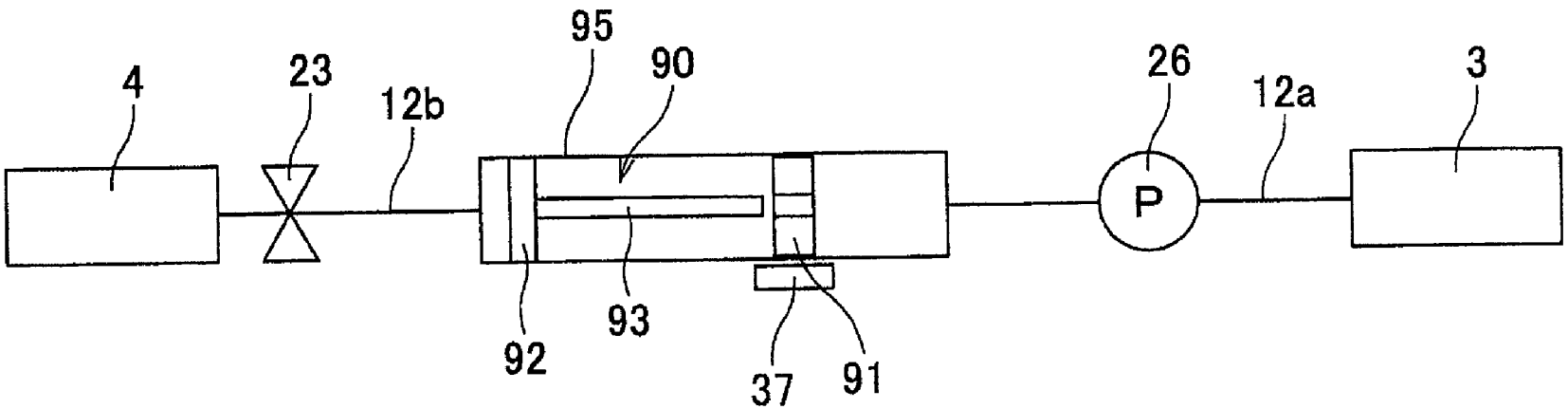
FIG. 11 is a view showing still another modification of the first embodiment in which a disk-shaped body having a through-hole is provided in place of the spherical body.
Figure 12:
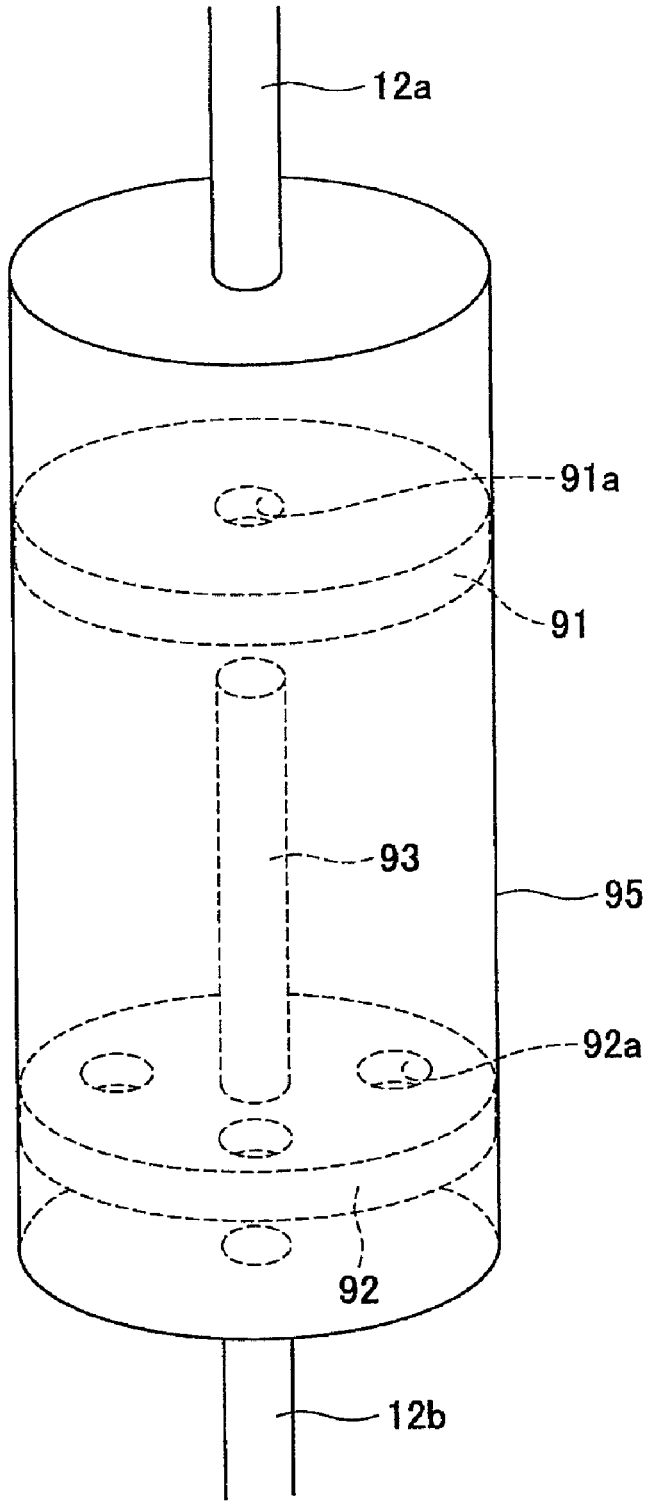
FIG. 12 is a perspective view showing the quantitative ink supplier in the modification shown in FIG. 11.

Further, in the above-described first embodiment, the movable body movable within the inner space 34 of the tubular portion 31*b* is provided by the spherical body 35. However, as shown in FIGS. 11 and 12, the movable body may be provided by, in place of the spherical body 35, a disk-shaped body 91 that is made of a magnetic material. The disk-shaped body 91 is disposed in an inner space 90 defined in a tubular portion 95, and has a through-hole 91*a* at its center. The inner space 90 has a diameter which is constant from its upstream end to its downstream end and which permits a small clearance to be defined between the disk-shaped body 91 and an inner surface of the tubular portion 95. Another disk-shaped body 92 is disposed on an upstream side of the downstream end of the inner space 90, and has the same diameter as the inner space 90. A plurality of through-holes 92*a* are provided in non-central portions of the disk-shaped body 92. A cylindrical rod 93 having substantially the same diameter as the through-hole 91*a* of the disk-shaped body 91 extends axially from a center of the disk-shaped body 92 to a non-end portion of the inner space 90.

In the modification of FIGS. 11 and 12, the disk-shaped body 91 is movable between the upstream and downstream ends of the inner space 90. When the disk-shaped body 91 has been moved to the above-described non-end portion of the inner space 90, the cylindrical rod 93 is introduced into the through-hole 91*a* of the disk-shaped body 91. The disk-shaped body 91 can be moved up to a position in which the disk-shaped body 91 is brought into contact with the disk-shaped body 92, while the cylindrical rod 93 is being introduced in the through-hole 91*a* of the disk-shaped body 91. The disk-shaped body 91 is moved by the magnet 37 as in the above-described first embodiment. In this modification, the waiting position corresponds to an upstream end portion of the inner space 90, the movement start position corresponds to the above-described non-end portion of the inner space 90 (in which the cylindrical rod 93 is introduced into the through-hole 91*a* of the disk-shaped body 91), and the movement termination position corresponds to a downstream end portion of the inner space 90. Thus, a portion of the inner space 90 extending from the above-described non-end portion to the downstream end portion corresponds to the small-clearance defining portion.

In the modification of FIGS. 11 and 12, during the printing operation, recycle purge operation and massive purge operation, the disk-shaped body 91 is kept positioned in the waiting position, and the valve 23 is opened under control of the valve controlling portion 62. During the printing operation, the head drive circuit 71 is controlled by the head controlling portion 61 such that the ink is supplied from the subtank 3 toward the inkjet head 4 via the through-hole 91*a* of the disk-shaped body 91 and the through-holes 92*a* of the disk-shaped body 92. During the recycle purge operation and massive purge operation, the centrifugal pump 26 is driven under control of the centrifugal pump controlling portion 63 whereby the ink is supplied from the subtank 3 toward the inkjet head 4 via the through-hole 91*a* and the through-holes 92*a*. During the quantitative purge operation, the valve 23 is opened under control of the valve controlling portion 62. Prior to the quantitative purge operation, the magnet 37 is first positioned in a position which is close to the disk-shaped body 91 in the vertical direction and which is opposed to the disk-shaped body 91 in the vertical direction, and is then moved in the ink supplying direction by driving the rotary motor 45 under control of the magnet movement controlling portion 66, as in the first embodiment, such that the disk-shaped body 91 is moved from the waiting position to the movement start position. When the disk-shaped body 91 has been moved to the movement start position, the magnet 37 is vertically moved in a direction away from the tubular portion 31*b*, by activation of the rotary motor 52 under control of the magnet movement controlling portion 66, whereby the disk-shaped body 91 is released from a magnetic force of the magnet 37. The quantitative purge operation is carried out by activation of the centrifugal pump 26 under control of the centrifugal pump controlling portion 63, as in the above-described first embodiment. That is, the disk-shaped body 91 is forced, by the activation of the centrifugal pump 26, in the ink supplying direction, so as to be moved from the movement start position to the movement termination position, whereby a predetermined amount of the ink stored within the small-clearance defining portion is forced to flow toward the inkjet head 4.

Second Embodiment

Figure 13:
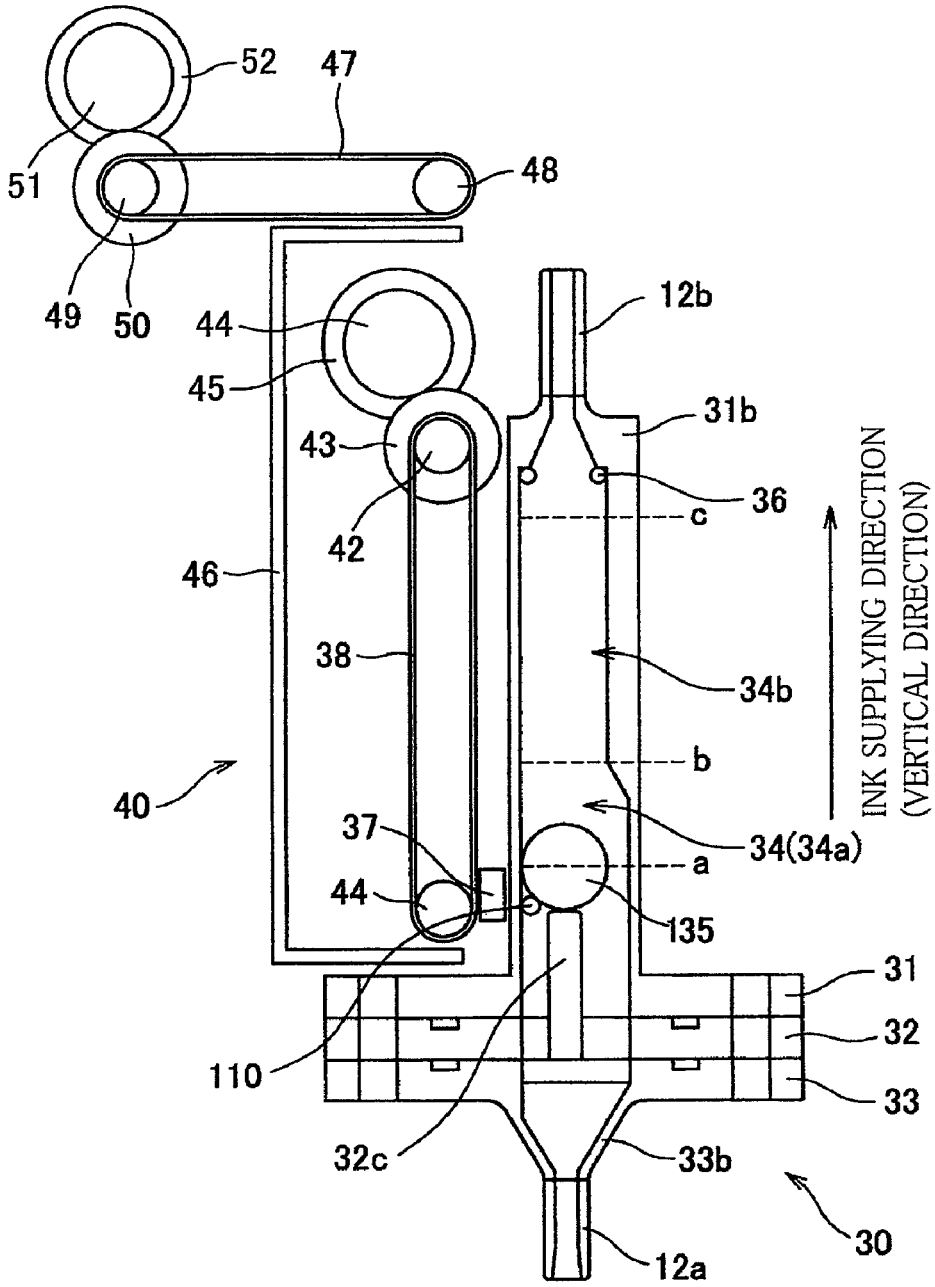
FIG. 13 is a view showing the quantitative ink supplier together with the magnet movement mechanism in an inkjet printer constructed according to a second embodiment of the invention.
Figure 14:
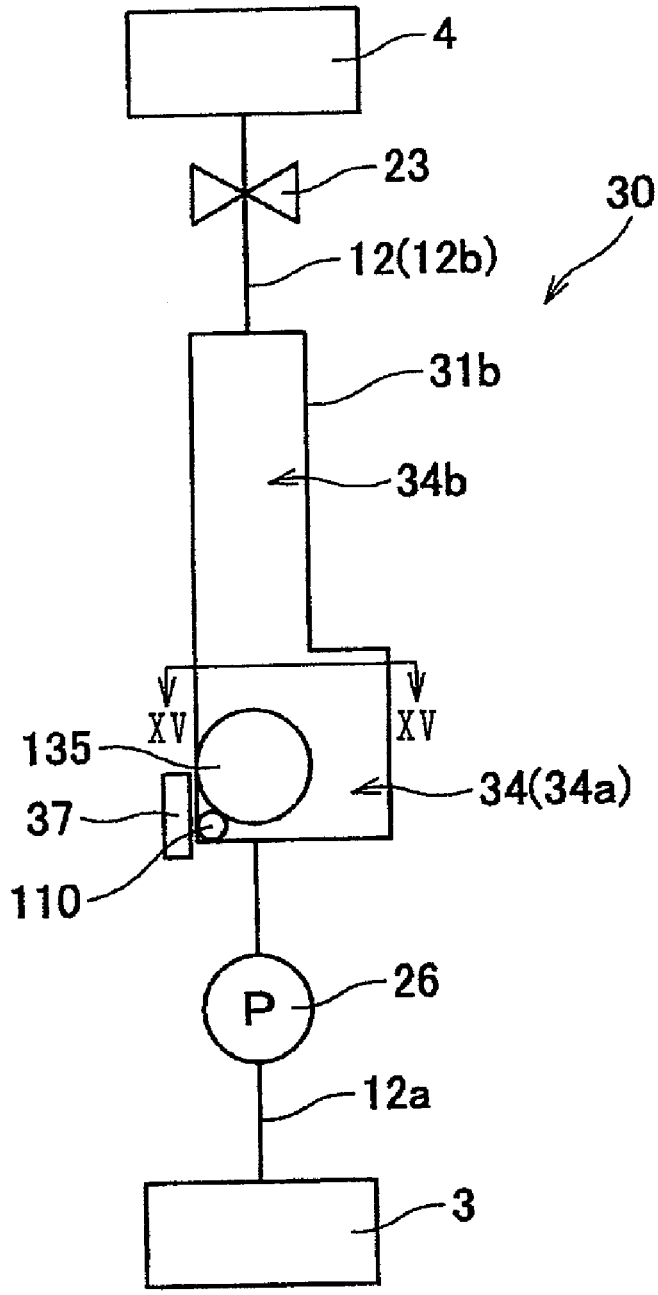
FIG. 14 is a view showing the quantitative ink supplier together with the inkjet head and the subtank that are connected to the quantitative ink supplier, in the second embodiment shown in FIG. 13.
Figure 15:
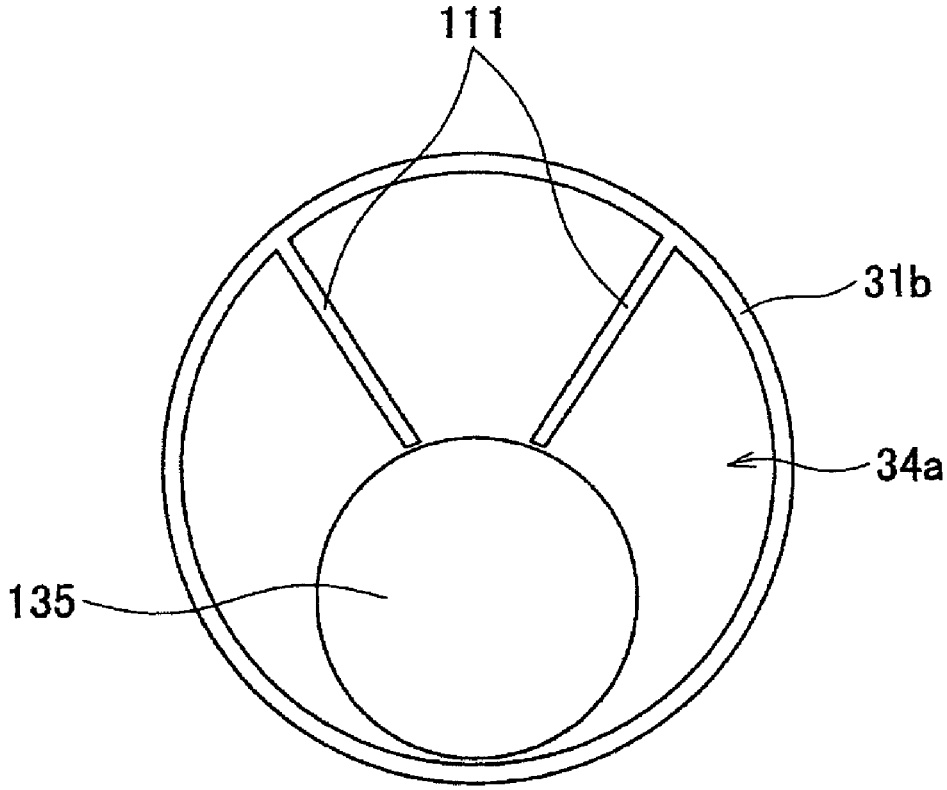
FIG. 15 is a cross sectional view taken in line XV-XV in FIG. 14.

FIG. 13 shows the quantitative ink supplier together with the magnet movement mechanism in an inkjet printer constructed according to a second embodiment of the invention. FIG. 14 shows the quantitative ink supplier together with the inkjet head and the subtank that are connected to the quantitative ink supplier, in the second embodiment. FIG. 15 is a cross sectional view taken in line XV-XV in FIG. 14. The second embodiment is substantially identical with the above-described first embodiment only except for posture and construction in the quantitative ink supplier 30. In the following description of the second embodiment, the same reference signs as used in the description of the first embodiment are used to identify the same components or elements, which will not be described to avoid redundancy of the description.

As shown in FIGS. 13 and 14, the quantitative ink supplier 40 extends in a vertically upward direction, the tubular portion 31*b* includes an upper end portion as its downstream end portion, which is connected to the downstream-side tube portion 12*b* that is connected to the inkjet head 4. That is, a spherical body 135 is moved from the waiting position to the movement termination position via the movement start position, by causing the spherical body 135 to be moved in the vertically upward direction. It is noted that, in this modification, the tubular portion 31*b* does not necessarily have to extend precisely in an upright direction, but may extend in a diagonal direction as long as the diagonal direction includes a component parallel to the upright direction. The spherical body 135, which is movable only within the tubular portion 31*b*, has a gravity that is larger than a specific gravity of the ink, and is made of a non-magnetic material. The spherical body 135 is different from the spherical body 35 used in the first embodiment only in that the spherical body 135 is made of the non-magnetic material, and is the same as the spherical body 35 with respect to the size and shape.

In the second embodiment, the moving device, which is configured to move the spherical body 135 as a first movable body, includes a spherical body 110 as a second movable body. The spherical body 110 has a diameter smaller than a diameter of the spherical body 135. The spherical body 110 is made of a magnetic material (ferromagnetic material), and is disposed in the inner space 34 of the tubular portion 31*b*. The spherical body 110 is located on an upstream side of the spherical body 135 in the ink supplying direction, such that the spherical body 135 can be pushed by the spherical body 110 in a direction toward the recording head 4. The spherical body 110 is movable in directions parallel to the vertical direction together with movement of the magnet 37 which is made by the magnet movement mechanism 40. As shown in FIG. 15, when the spherical body 135 is being positioned in the upstream-side space 34*a*, the spherical body 135 is supported by two support plates 111, so as to be movable only in the upright direction toward the downstream-side space 34*b*. In the second embodiment, the printing operation, recycle purge operation and massive purge operation are carried out substantially in the same manners as those in the first embodiment, so that descriptions of these operations are not provided herein.

Figure 16:
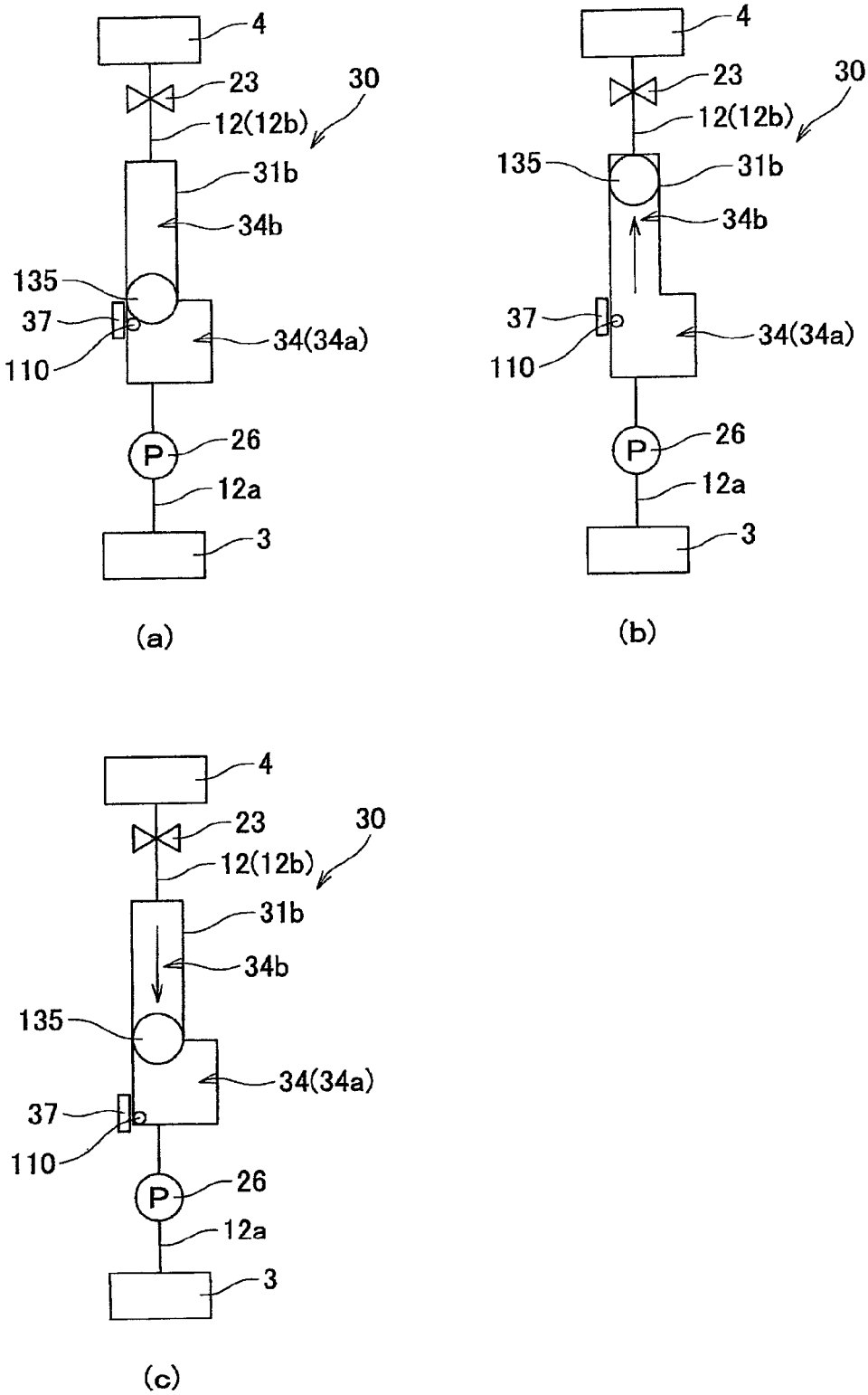
FIG. 16 is a set of views for describing a quantitative purge operation performed in the inkjet printer of the second embodiment, wherein view (*a*) shows a stage in which the spherical body has been moved to the first position, view (*b*) shows a stage in which the spherical body has been moved to the second position from the first position, and view (*c*) shows a stage in which the spherical body has been moved back to the first position.

Referring next to FIG. 16, there will be described the quantitative purge operation carried out in the inkjet printer according to the present second embodiment. Prior to the quantitative purge operation, the magnet 37 is first positioned in a position which is close to the tubular portion 31*b* in the horizontal direction and which is almost opposed to the waiting position in the horizontal direction, and is then moved upwardly by activation of the rotary motor 45 under control of the magnet movement controlling portion 66. In this instance, the spherical body 110 is moved upwardly together with the upward movement of the magnet 37 so as to be positioned in a position (hereinafter referred to as "elevating position") that causes the spherical body 135 to be elevated to the movement start position, whereby the spherical body 135 is pushed by the spherical body 110 so as to be moved upwardly from the waiting position to the movement start position, as shown in view (*a*) of FIG. 16. The upward movement of the magnet 37 is stopped when the spherical body 135 has been moved to the movement start position.

Then, the quantitative purge operation is carried out by activation of the centrifugal pump 26 under control of the centrifugal pump controlling portion 63. That is, the spherical body 135 is forced upwardly, by the activation of the centrifugal pump 26, in the ink supplying direction, so as to be moved upwardly from the movement start position to the movement termination position, as shown in view (*b*) of FIG. 16. During the movement of the spherical body 135 from the movement start position to the movement termination position, the ink flows very little via the small clearance between the spherical body 135 and the inner surface of the tubular portion 31*b*, so that a predetermined amount of the ink stored within the downstream-side space 34*b* as the small-clearance defining portion is forced to flow toward the inkjet head 4. In this instance, since the spherical body 135 is made of the non-magnetic material, the spherical body 135 is not attracted by the magnet 37. Therefore, the spherical body 135 can be easily moved, by the activation of the centrifugal pump 26, from the movement start position to the movement termination position.

In the inkjet printer according to the second embodiment, the downstream-side tube portion 12*b*, which is connected to the inkjet head 4, is connected to the upper end portion of the tubular portion 31*b*. Owing to this arrangement, even if air is introduced into the inner space 34 of the tubular portion 31*b*, the air can be discharged upwardly from the inner space 34, thereby avoiding the air from being trapped in the inner space 34. It is therefore possible to reliably cause a predetermined amount of the ink to flow from the downstream-side space 34*b* as the small-clearance defining portion toward the inkjet head 4. After the quantitative purge operation, the spherical body 135 is slowly moved down from the movement termination position to the movement start position, as shown in view (*c*) of FIG. 16, owing to the specific gravity of the spherical body 135 that is larger than the specific gravity of the ink. The spherical body 135 can be rapidly moved down from the movement start position to the waiting position.

Figure 17:
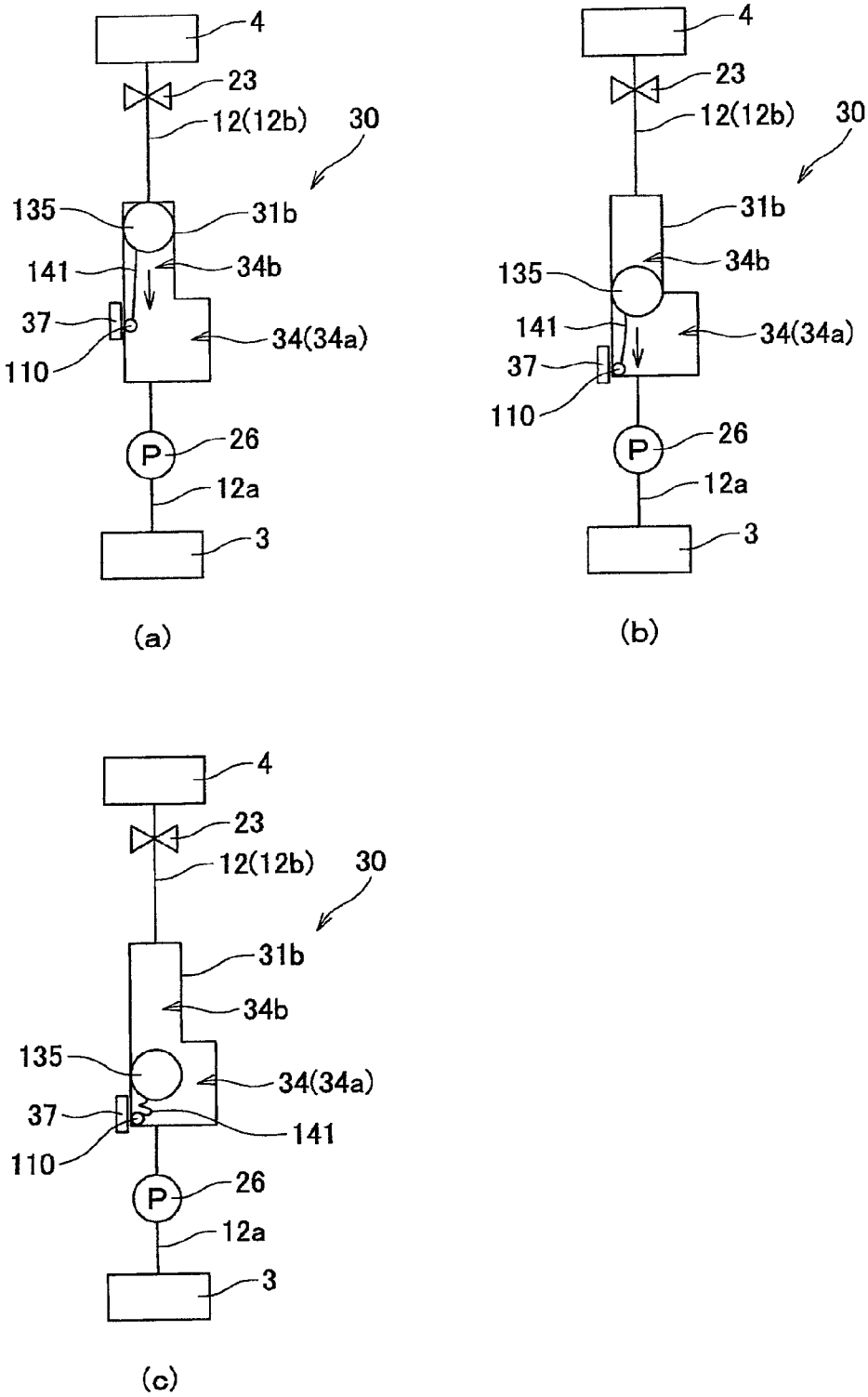
FIG. 17 is a set of views for describing the quantitative purge operation performed in an inkjet printer constructed according to a modification of the second embodiment, wherein view (*a*) shows a stage in which the spherical body has been moved to the second position from the first position, view (*a*) shows view (*b*) shows a stage in which the spherical body has been moved back to the first position, and view (*c*) shows a stage in which the spherical body has been moved back to the waiting position (third position)

There will be described various modifications of the second embodiment. FIG. 17 shows a modification in which the spherical bodies 135, 110 are connected to each other via a cord 141 that is freely flexible. The cord 141 has a length which is larger than a distance between the spherical bodies 110, 135 when the spherical body 110 is positioned in the above-described elevating position while the spherical body 135 is positioned in the movement termination position, and which is smaller than a distance between the spherical bodies 110, 135 when the spherical body 110 is positioned in an upstream end portion of the inner space 34 of the tubular portion 31*b* while the spherical body 135 is positioned in the movement start position.

In the modification shown in FIG. 17, the quantitative purge operation is carried out in substantially the same manner as in the above-described second embodiment. After the quantitative purge operation, the magnet 37 is moved downwardly from a position that is opposed to the above-described elevating position (see view (*a*) of FIG. 17), by activation of the rotary motor 45 under control of the magnet movement controlling portion 66, such that the spherical body 110 is moved downwardly to the upstream end portion of the inner space 34. The spherical body 135 is pulled by the cord 141 that is connected to the spherical body 110, so as to be moved downwardly to the movement start position, as shown in view (*b*) of FIG. 17. In this instance, if the spherical body 132 were moved downwardly only by its self-weight, the downward movement of the spherical body 132 would be slow, because the clearance between the spherical body 135 and the inner surface of the tubular portion 31*b* in the downstream-side space 34*b* is small. However, in this modification, the spherical body 135 can be moved downwardly to the movement start position at a high velocity, since the spherical body 135 is pulled downwardly by the cord 141 that is connected to the spherical body 110. After having been pulled by the cord 141 downwardly to the movement start position, the spherical body 135 is rapidly moved by its self-weight downwardly from the movement start position to the waiting position.

Figure 18:
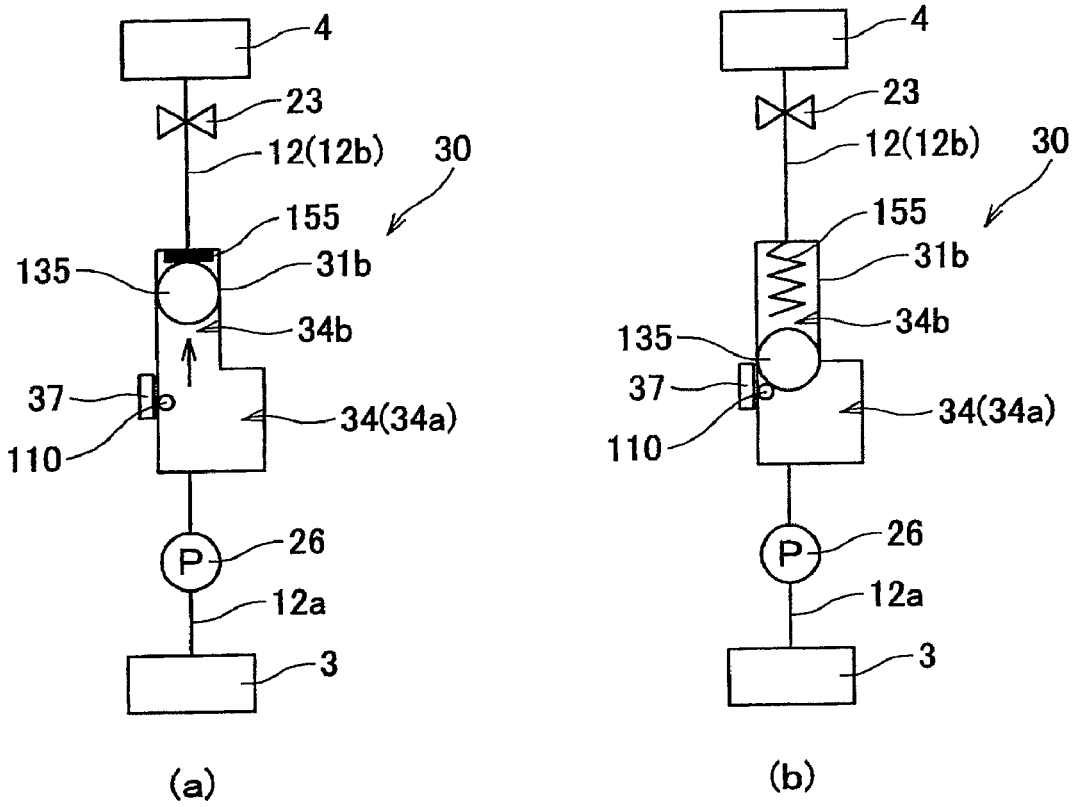
FIG. 18 is a set of views for describing the quantitative purge operation performed in an inkjet printer constructed according to another modification of the second embodiment, wherein view (*a*) shows a stage in which the spherical body has been moved to the second position from the first position, and view (*b*) shows a stage in which the spherical body has been moved back to the first position.

FIG. 18 shows another modification in which the spherical body 135 is moved back from the movement termination position to the movement start position, by an elastic body in the form of a spring 155, rather than by only its self-weight. In this modification of FIG. 18, the spring 155 is disposed in the inner space 34 of the tubular portion 31*b*, and is located on a downstream side of the spherical body 135 in the ink supplying direction. When the spherical body 135 is being positioned in the movement termination position, the spring 155 is elastically deformed or compressed by the spherical body 135, as shown in view (*a*) of FIG. 18. When activation of the centrifugal pump 26 is stopped, the spherical body 135 can be moved back from the movement termination position to the movement start position at a high velocity owing to a restoring force of the spring 155, as shown in view (*b*) of FIG. 18. After having been moved back to the movement start position by the spring 155, the spherical body 135 is rapidly moved by its self-weight downwardly from the movement start position to the waiting position.

Figure 19:
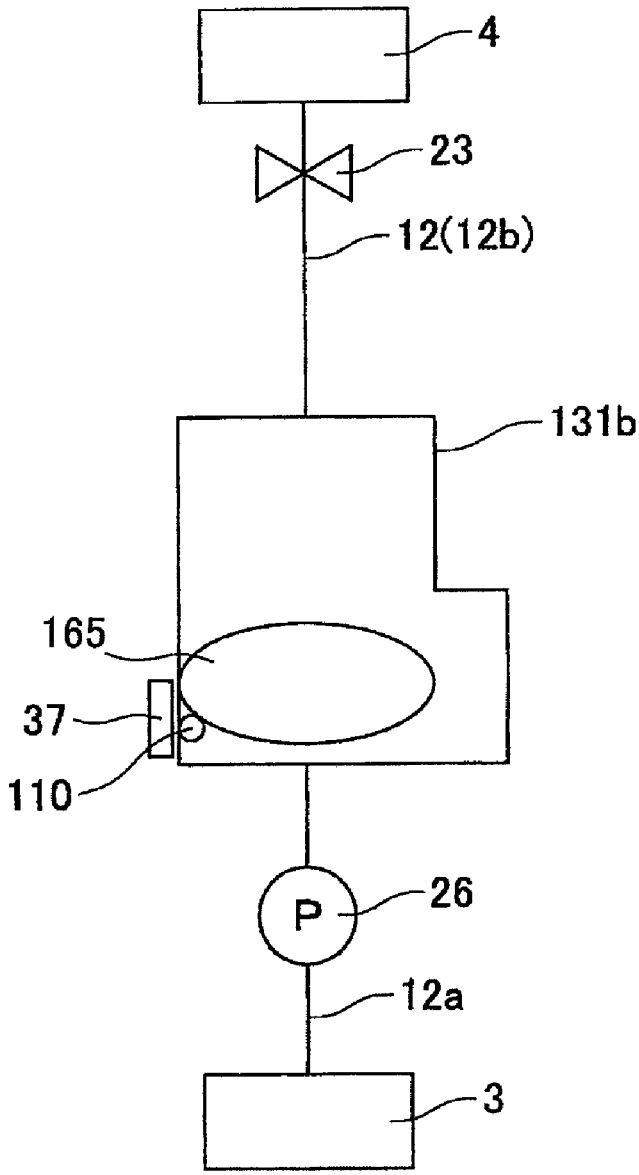
FIG. 19 is a view showing the quantitative ink supplier together with an inkjet head and a subtank that are connected to the quantitative ink supplier, in still another modification of the second embodiment in which the quantitative ink supplier has a large diameter.

FIG. 19 shows still another modification in which a tubular portion 131*b* has a diameter larger than a diameter of the tubular portion 31*b* used in the second embodiment, and a spherical body 165 has a diameter larger than the spherical body 135 used in the second embodiment. Owing to the large diameters of the tubular portion 131*b* and the spherical body 155, the spherical body 155 is not required to be moved by a distance as large as that required in the above-described second embodiment, for causing the ink to flow toward the inkjet head 4 by an amount as large as that in the second embodiment. Therefore, a distance between the movement start position and the movement termination position is made smaller than that in the second embodiment, so that a length of time required for moving the spherical body from the movement termination position to the movement start position can be made smaller than that in the second embodiment.

Third Embodiment

Figure 20:
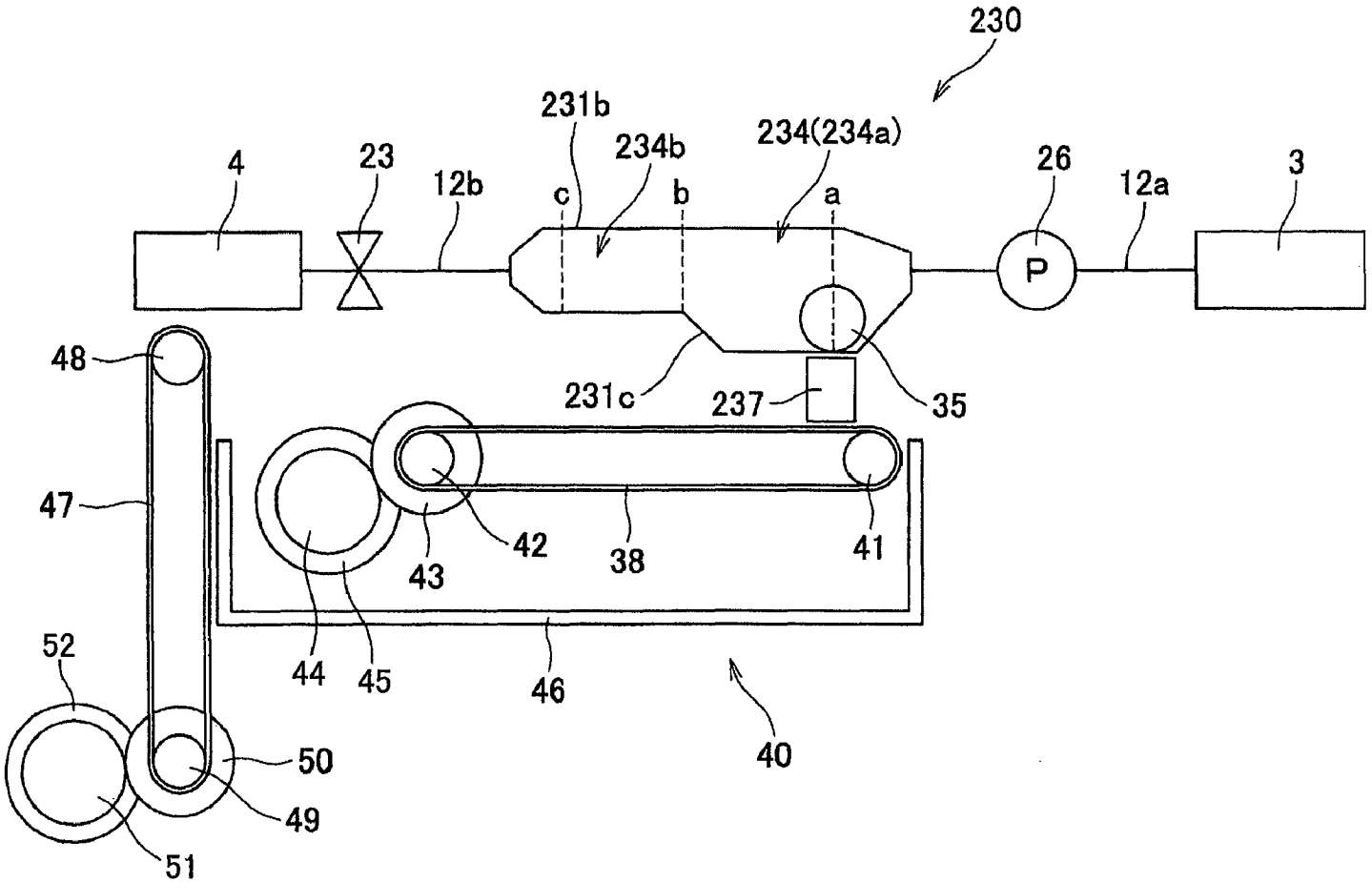
FIG. 20 is a view showing the quantitative ink supplier together with the magnet movement mechanism in an inkjet printer constructed according to a third embodiment of the invention.

FIG. 20 shows the quantitative ink supplier together with the magnet movement mechanism in an inkjet printer constructed according to a third embodiment of the invention. The third embodiment is substantially identical with the above-described first embodiment only except that the quantitative ink supplier 30 is replaced by a quantitative ink supplier 230. In the following description of the third embodiment, the same reference signs as used in the description of the first embodiment are used to identify the same components or elements, which will not be described to avoid redundancy of the description.

As shown in FIG. 20, a tubular portion 231*b* of the quantitative ink supplier 230 has a shape that is inverse to a shape of the tubular portion 31*b* of the quantitative ink supplier 30. The tubular portion 231 defines an inner space 234 having an upstream-side tapered portion, a large diameter portion, a transition portion, a small diameter portion and a downstream-side tapered portion which are arranged in this order of description as viewed in the ink supplying direction, as shown in FIG. 20. The upstream-side tapered portion extends from an upstream end of the tubular portion 231*b*, and is tapered in both of its upper and lower portions, so as to have a diameter that is gradually increased in the ink supplying direction. The large diameter portion extends from the upstream-side tapered portion to an intermediate portion of the tubular portion 231*b*, and has a constant diameter. The transition portion interconnects the large diameter portion and the small diameter portion, and has a diameter that is gradually reduced in the ink supplying direction. The small diameter portion extends from the transition portion to a portion adjacent to a downstream end of the tubular portion 231*b*, and has a constant diameter that is smaller than the diameter of the large diameter portion. The large diameter portion and the small diameter portion have respective axes that are offset from each other such that the axis of the small diameter portion is located on an upper side of the axis of the large diameter portion and such that upper surfaces of the respective large diameter portion, transition portion and small diameter portion are substantially flush with one another. The downstream-side tapered portion extends from the small diameter portion to the downstream end of the tubular portion 231*b*, and has a diameter that is gradually reduced in the ink supplying direction. That is, the tubular portion 231 includes a downwardly convex portion 231*c* that is provided by parts of the respective upstream-side tapered portion, large diameter portion and transition portion. In the downwardly convex portion 231*a*, the inner space 234 is downwardly convex. In a downstream end portion of the above-described small diameter portion of the inner space 234, there is provided a sealing member in the form of an O-ring (not shown) that is made of an elastic material such as a rubber. The O-ring, which is thus provided in the downstream end portion of the small diameter portion of the inner space 234, is fitted in the inner surface of the tubular portion 231*b*.

As shown in FIG. 20, the inner space 234 of the tubular portion 231*b* is sectioned into an upstream-side space 234*a* and a downstream-side space 234*b* that are respectively located on an upstream side and a lower stream side of the movement start position b in the ink supplying direction. The movement start position b corresponds to a boundary between the above-described transition portion and small-diameter portion of the inner space 234.

In the inner space 234 of the tubular portion 231*b*, there is disposed the spherical body 35 as the movable body which is made of a magnetic material (ferromagnetic material) and which is movable only within the inner space 234. The spherical body 35 is movable, together with movement of a magnet 237 that is elongated in the vertical direction, from the waiting position a that is adjacent to the upstream-side tapered portion of the inner space 234, to the movement termination position c that corresponds to the downstream-side movement end position, via the movement start position b that corresponds to the boundary between the above-described transition portion and small-diameter portion of the inner space 234, namely, the boundary between the upstream-side space 234*a* and the downstream-side space 234*b* as the small-clearance defining portion.

As shown in FIG. 20, the magnet 237 and the magnet movement mechanism 40 are provided outside the tubular portion 231*b*. The magnet 237 and the magnet movement mechanism 40 serve as the attracting portion and the moving portion of the moving device, respectively. The magnet movement mechanism 40 includes the belts 38, 47, pulleys 41, 42, 48, 49, gears 43, 44, 50, 51, rotary motors 45, 52 and tray 46.

The magnet 237 as the attracting portion is disposed in proximity to the outer surface of the tubular portion 231*b*, and is fixed to the endless belt 38. The belt 38 is stretched around the pulleys 41, 42 that are spaced apart from each other in a direction parallel to the ink supplying direction (i.e., leftward direction as seen in FIG. 20). The pulley 41 overlaps with a part of the spherical body 35 as seen in a vertical direction that is substantially perpendicular to the ink supplying direction, when the spherical body 35 is being positioned in the waiting position c. Meanwhile, the pulley 42 is located on a downstream side of the above-described O-ring (not shown) in the ink supplying direction.

The gear 43 is fixed to an axial end portion of the pulley 42, and meshes with the gear 44 that is connected to the rotary motor 45. That is, when the rotary motor 45 is driven, the gear 44 is rotated and also the gear 43 meshing with the gear 44 is rotated, so that the belt 38 is caused to run as a result of rotation of the pulley 42 that is connected to the gear 43. With the running of the belt 38, the magnet 237 is moved in directions parallel to the ink supplying direction. Thus, the magnet 237 is reciprocatable between two positions which correspond to the waiting position a and the movement termination position c.

The above-described magnet 237, belt 38, pulleys 41, 42, gears 43, 44 and rotary motor 45 are fixedly disposed in the tray 46 that is fixed to the endless belt 47. The belt 47 is stretched around the pulleys 48, 49 that are spaced apart from each other in a vertical direction perpendicular to the ink supplying direction. The pulley 48 is located on an upper side of the pulleys 41, 42, and overlaps with the spherical body 35 as seen in the ink supplying direction when the spherical body 35 is being positioned in the waiting position a. Meanwhile, the pulley 49 is located on a lower side of the pulley 48, namely, is located in a position that is more distant, than the pulley 48, from the tubular portion 231*b* in the vertical direction.

The gear 50 is fixed to an axial end portion of the pulley 49, and meshes with the gear 51 that is connected to the rotary motor 52. That is, when the rotary motor 52 is driven, the gear 51 is rotated and also the gear 50 meshing with the gear 51 is rotated, so that the belt 47 is caused to run as a result of rotation of the pulley 49 that is connected to the gear 50. With the running of the belt 47, the tray 46 together with the magnet 237, belt 38, pulleys 41, 42, gears 43, 44 and rotary motor 45 that are disposed in the tray 46 is moved in directions parallel to the vertical direction. Thus, owing to the magnet movement mechanism 40, the magnet 237 is reciprocatable in the directions parallel to the vertical direction as well as in the directions parallel to the ink supplying direction.

In the present third embodiment, the printing operation, quantitative purge operation, recycle purge operation and massive purge operation are carried out substantially in the same manners as those in the first embodiment, so that descriptions of these operations are not provided herein.

Figure 21:
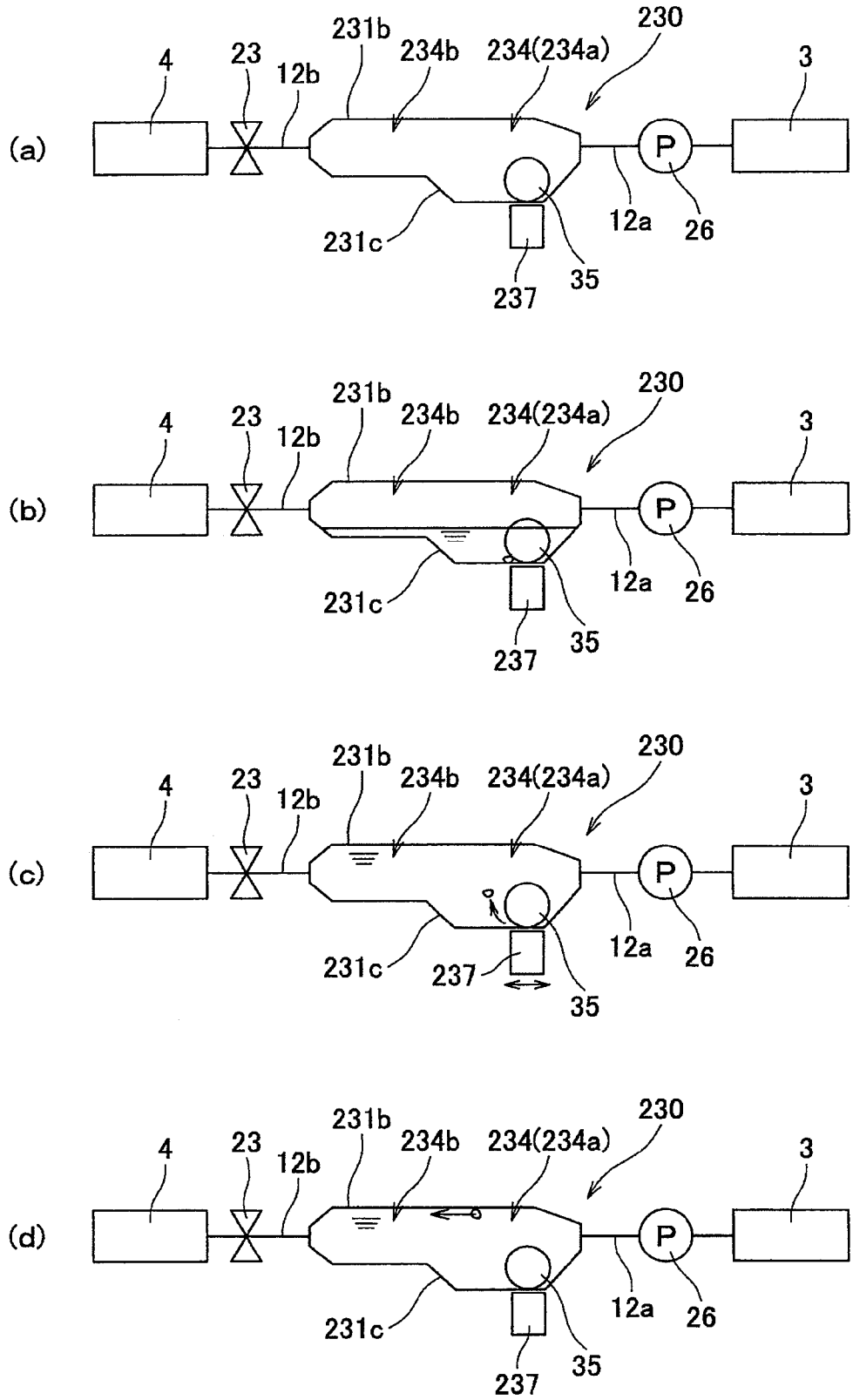
FIG. 21 is a set of views for describing an operation which is performed in the inkjet printer of the third embodiment, for supplying ink to the quantitative ink supplier from the subtank, wherein view (*a*) shows a stage in which the ink is not yet supplied to the quantitative ink supplier, view (*b*) shows a stage in which the ink is being supplied to the quantitative ink supplier, view (*c*) shows a stage in which supply of the ink to the quantitative ink supplier has been completed, and view (*d*) shows a stage in which a cycle purge operation is being performed.

There will be next described a storing operation that is carried out for introducing the ink from the subtank 3 to the inner space 234 of the tubular portion 231*b*, so as to store the ink in the inner space 234. FIG. 21 is a set of views for describing the storing operation performed in the inkjet printer according to the third embodiment. Upon initiation of the storing operation, as shown in view (*a*) of FIG. 21, the spherical body 35 is positioned in the waiting position that is located in the downwardly convex portion 231*c* of the upstream-side space 234*a*. In this instance, the spherical body 35 is attracted by the magnet 237. Therefore, as long as the magnet 237 is not moved, the spherical body 35 is not moved and is fixed in the waiting position.

While the spherical body 35 is kept positioned in the waiting position, the centrifugal pump 26 is driven under control of the centrifugal pump controlling portion 63 such that the ink is supplied from the subtank 3 to the inner space 234 of the tubular portion 231*b*. As the ink is supplied to the inner space 234, air bubbles are likely to remain on a downstream side of the spherical body 35 that is positioned in the downwardly convex portion 231*c*, as shown in view (*b*) of FIG. 21. After the ink has been stored in the inner space 234, the magnet 237 (positioned in a position which is close to the tubular portion 231*b* in the vertical direction and which is opposed to the waiting position in the vertical direction) is moved in rightward and leftward directions a plurality of times, by activating the rotary motor 45 under control of the magnet movement controlling portion 66, whereby the spherical body 35 is oscillated in directions parallel to the ink supplying direction, as shown in view (*c*) of FIG. 21. By the oscillation of the spherical body 35, the air bubbles having stayed on the downstream side of the spherical body 35 are caused to float up to an upper portion of the inner space 234, as shown in view (*d*) of FIG. 21. Then, by carrying out the recycle purge operation as in the above-described first embodiment, it is possible to return the ink containing the air bubbles, to the subtank 3 via the inkjet head 4, and to discharge the air bubbles through the opening 3*a* of the subtank 3 (see FIG. 1).

Figure 22:
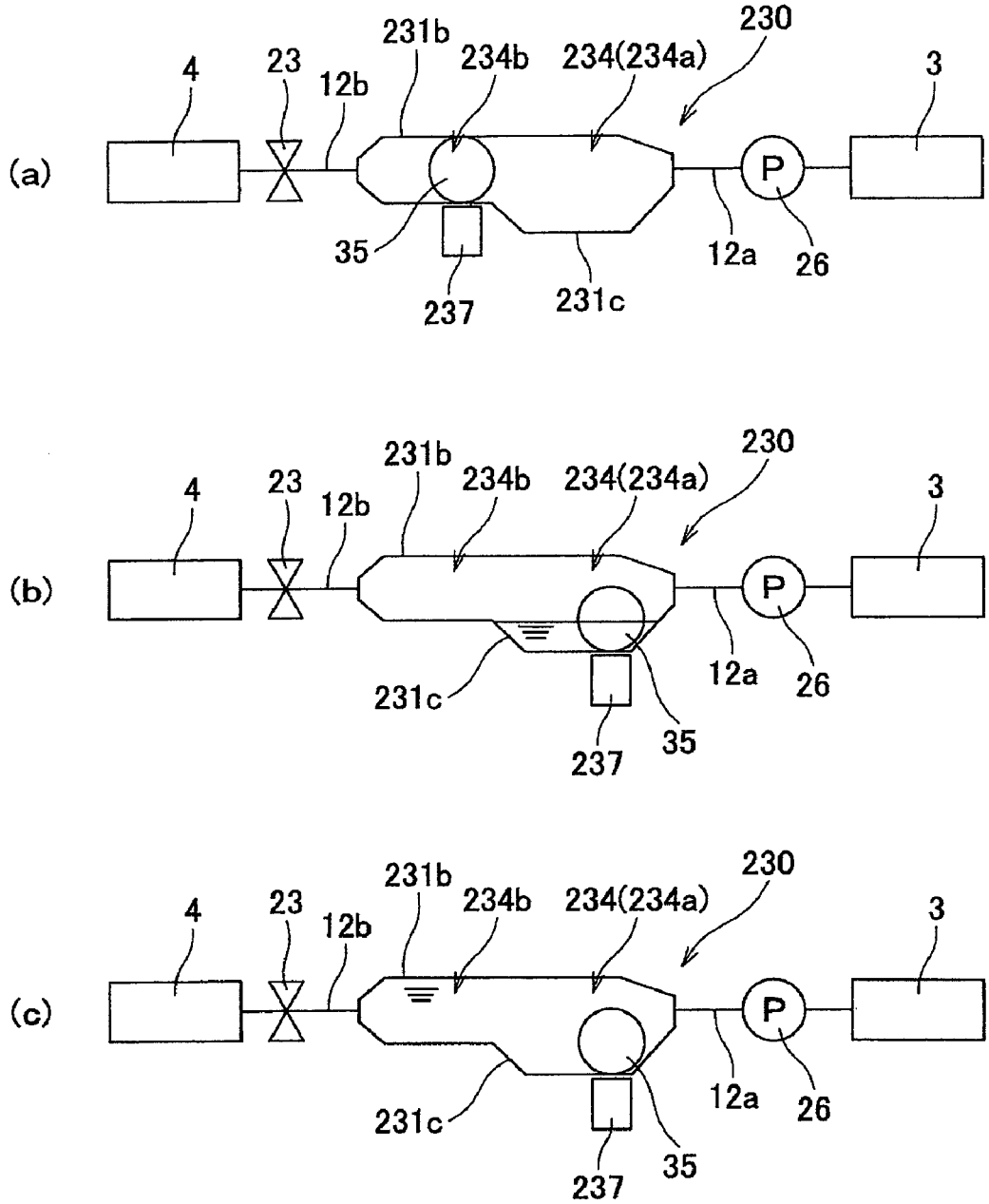
FIG. 22 is a set of views for describing a modification of the operation for supplying the ink to the quantitative ink supplier from the subtank, wherein view (*a*) shows a stage in which the ink is not yet supplied to the quantitative ink supplier, and view (*b*) shows a stage in which the ink is being supplied to the quantitative ink supplier.

There will be described modifications of the third embodiment. While the air bubbles are eliminated by vibrating the spherical body 35 in the third embodiment, the air bubbles may be eliminated in a manner as shown in FIG. 22. According to a modification shown in FIG. 22, upon initiation of the storing operation, the spherical body 35 is kept positioned in the downstream-side space 234*b*, as shown in view (*a*) of FIG. 22. In this instance, the spherical body 35 is attracted by the magnet 237. Therefore, as long as the magnet 237 is not moved, the spherical body 35 is not moved and is fixed in the downstream-side space 234*b*.

While the spherical body 35 is kept positioned in the downstream-side space 234*b*, the centrifugal pump 26 is driven under control of the centrifugal pump controlling portion 63 such that the ink is supplied from the subtank 3 to the inner space 234 of the tubular portion 231*b*. When the ink has been stored only in the downwardly convex portion 231*c*, as shown in view (*b*) of FIG. 22, the magnet 237 (positioned in a position which is close to the tubular portion 231*b* in the vertical direction and which is opposed to the downstream-side space 234*b*) is moved by activating the rotary motors 45, 52 under control of the magnet movement controlling portion 66, such that the spherical body 35 is moved from the downstream-side space 234*b* to the upstream-side space 234*a* so as to be positioned in the waiting position. Thus, until the ink is stored in the downwardly convex portion 231*c*, the spherical body 35 is kept positioned in the downstream-side space 234*b*, for thereby making it possible to prevent the air bubbles from staying on the downstream side of the spherical body 35. The supply of the ink from the subtank 3 to the inner space 234 is completed, as shown in view (*c*) of FIG. 22, after the spherical body 35 has been moved to the waiting position.

Figure 23:
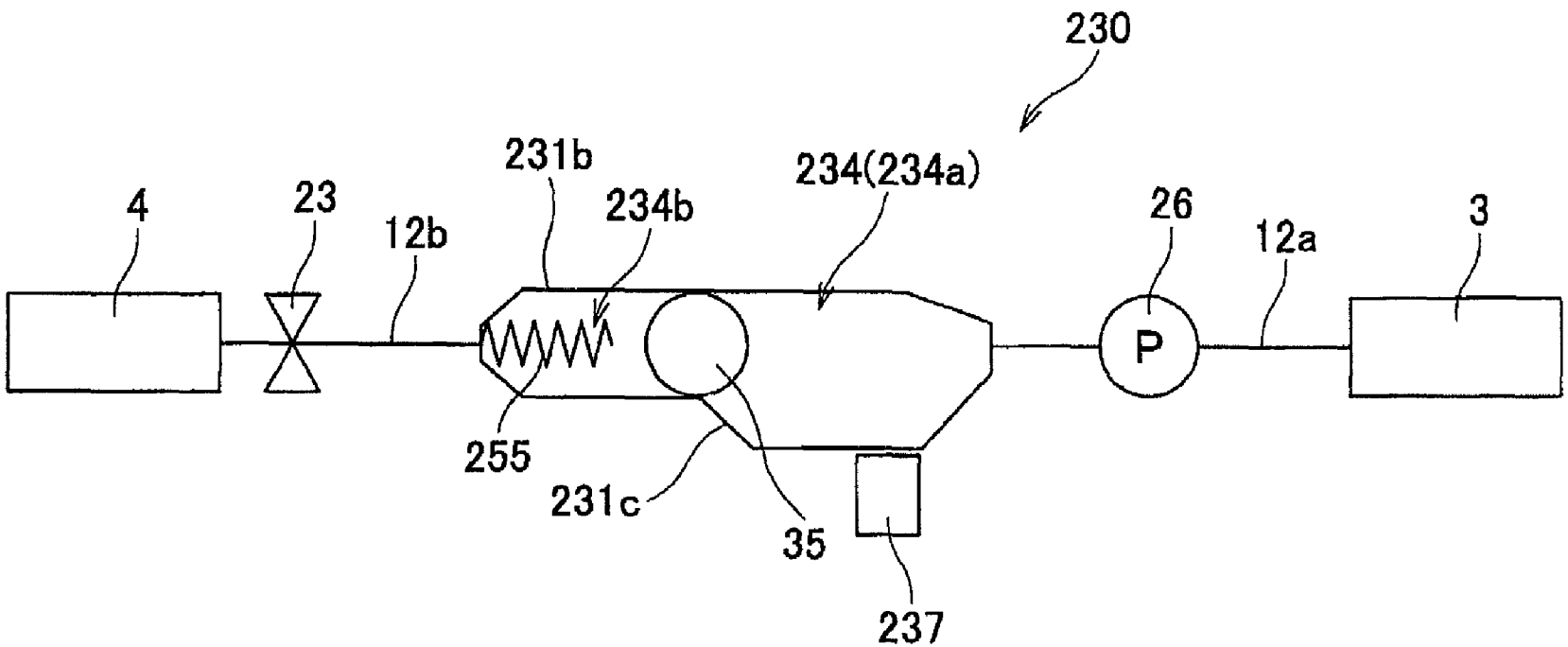
FIG. 23 is a view showing another modification of the third embodiment in which a spring is provided in the quantitative ink supplier.

Further, as shown in FIG. 23, the spherical body 35 may be moved from the movement termination position to the movement start position by a spring 255 as an elastic body, rather than by the magnet 237. In the modification shown in FIG. 23, the spring 255 is disposed in the downstream-side space 234*b* so as to be located on a downstream side of the spherical body 35. When the spherical body 35 is being positioned in the movement termination position, the spring 255 is elastically deformed or compressed by the spherical body 35. When the activation of the centrifugal pump 26 is stopped, the spherical body 35 is moved back from the movement termination position to the movement start position, owing to a restoring force of the spring 255.

Further, the third embodiment may be modified such that the tubular portion 231*b* extends in a vertically upward direction rather than in a horizontal direction, so that the spherical body 35 is moved from the waiting position to the movement termination position via the movement start position, by causing the spherical body 35 to be moved in the vertically upward direction. In this modification, the spherical body 35 has a specific gravity that is larger than a specific gravity of the ink, whereby the spherical body 35 can be moved, owing to a self-weight of the spherical body 35, from the movement termination position to the waiting position via the movement start position. It is noted that, in this modification, the tubular portion 231*b* does not necessarily have to extend precisely in an upright direction, but may extend in a diagonal direction as long as the diagonal direction includes a component parallel to the upright direction.

Further, in the above-described third embodiment, the O-ring is provided in the downstream end portion of the above-described small diameter portion of the inner space 234 which is contiguous to the downstream-side tapered portion of the inner space 234. However, the provision of the O-ring may be replaced by a modified arrangement in which an entire surface of the spherical body 35 is covered with a rubber or other elastic material having a small thickness, so that the sealing member is provided by the rubber covering the spherical body 35. In this modified arrangement, too, when the spherical body 35 is being positioned in the movement termination position, a fluid tightness between the spherical body 35 and the inner surface of the tubular portion 231*b* is established by the rubber covering the spherical body 35, thereby reliably stopping flow of the ink toward the inkjet head 4. Thus, the ink can be caused to flow accurately by the predetermined amount toward the inkjet head 4, as a result of the movement of the spherical body 35 from the movement start position to the movement termination position.

Moreover, in the above-described first, second and third embodiments, the movable body (such as the spherical bodies 35, 110, 165 and disk-shaped body 91) which is movable in the tubular portion is made of a magnetic material while the attracting portion of the moving device is made of a magnet. However, it is possible to modify such that the movable body is made of a magnet while the attracting portion of the moving device is made of a magnetic material.

Further, the inkjet recording apparatus according to the invention does not necessary have to be an inkjet printer, and may be even a non-printer apparatus such as facsimile and copying machines.

What is claimed is:

1. An inkjet recording apparatus comprising:

a recording head configured to eject ink toward a recording medium;

an ink supply source;

an ink supply conduit interconnecting said recording head and said ink supply source, such that the ink is supplied from said ink supply source to said recording head in an ink supplying direction;

a movable body disposed in said ink supply conduit and movable in said ink supply conduit;

a moving device configured to move said movable body in said ink supply conduit;

a valve disposed in said ink supply conduit and configured to selectively open and close said ink supply conduit; and a control device configured to control said moving device, wherein said ink supply conduit includes a reduced-clearance defining portion in which a total clearance between said moveable body and an inner surface of said ink supply conduit, when the moveable body is positioned in said reduced-clearance defining portion, is smaller than a total clearance between said moveable body and an inner surface of said ink supply conduit, when the moveable body is positioned at a larger-clearance defining portion, said reduced-clearance defining portion being located on an upstream side of said valve in said ink supplying direction, and wherein said control device is configured to control said moving device, such that said movable body is moved from a first position located in said reduced-clearance defining portion, to a second position located in said reduced-clearance defining portion, while said valve opens said ink supply conduit, whereby the ink within said reduced-clearance defining portion is caused to flow, via said valve opening said ink supply conduit, toward said recording head, said second position being located on a downstream side of said first position in said ink supplying direction;

wherein the moveable body is in direct contact with an inner surface of said ink supply conduit when the moveable body is in the first position, and the moveable body remains in direct contact with said inner surface as it is moved from the first position to the second position, and the moveable body remains in direct contact with said inner surface when it is in the second position;

wherein the moveable body is a sphere.

2. An inkjet recording apparatus comprising:

a recording head configured to eject ink toward a recording medium;

an ink supply source;

an ink supply conduit interconnecting said recording head and said ink supply source, such that the ink is supplied from said ink supply source to said recording head in an ink supplying direction;

a movable body disposed in said ink supply conduit and movable in said ink supply conduit;

a moving device configured to move said movable body in said ink supply conduit; and a control device configured to control said moving device, wherein said ink supply conduit includes a reduced-clearance defining portion in which a reduced clearance is to be defined between said movable body and an inner surface of said ink supply conduit when said movable body is being positioned in said reduced-clearance defining portion, wherein said control device is configured to control said moving device, such that said movable body is moved from a first position located in said reduced-clearance defining portion, to a second position located in said reduced-clearance defining portion, whereby the ink within said reduced-clearance defining portion is caused to flow toward said recording head, said second position being located on a downstream side of said first position in said ink supplying direction, wherein an ink-supply-source side portion and a recording-head side portion of said ink supply conduit, which are located on opposite sides of said movable body in said ink supplying direction, are held in communication with each other through a larger-clearance defining portion which is defined in said ink supply conduit when said movable body is being positioned in a third position that is located on an upstream side of said first position in said ink supplying direction, and wherein said larger-clearance defining portion has a cross sectional area that is larger than a cross sectional area of said reduced clearance defining portion.

3. The inkjet recording apparatus according to claim 2, wherein said control device is configured to control said moving device such that said movable body is moved from said third position to said first position and is then moved from said first position to said second position.

4. The inkjet recording apparatus according to claim 3,
wherein said moving device includes an attracting portion and a moving portion configured to move said attracting portion;
wherein at least one of said movable body and said attracting portion of said moving device is at least partially made of a magnet,
wherein said attracting portion is disposed in proximity to said ink supply conduit such that said movable body disposed in said ink supply conduit can be attracted by said attracting portion owing to a magnetic force of said magnet, and
wherein said control device is configured to control said moving portion such that said attracting portion is moved along said ink supply conduit in a direction toward said recording head, from a position opposed to said third position, for thereby moving said movable body from said third position to said first position.

5. The inkjet recording apparatus according to claim 1, further comprising a bypass conduit which bypasses said reduced-clearance defining portion and which interconnects two interconnected portions of said ink supply conduit, one of said two interconnected portions being located between said first position and said ink supply source in said ink supplying direction, the other of said two interconnected portions being located between said second position and said recording head in said ink supplying direction,
wherein said bypass conduit is provided with a valve that is configured to selectively open and close said bypass conduit.

6. The inkjet recording apparatus according to claim 1,
wherein said moving device includes a pump, and
wherein said control device is configured to control said pump such that said movable body is moved, by activation of said pump, from said first position to said second position.

7. The inkjet recording apparatus according to claim 6, wherein said pump is other than a positive-displacement pump.

8. The inkjet recording apparatus according to claim 1,
wherein said moving device includes an attracting portion and a moving portion configured to move said attracting portion;
wherein at least one of said movable body and said attracting portion is at least partially made of a magnet,
wherein said attracting portion is disposed in proximity to said ink supply conduit such that said movable body disposed in said ink supply conduit can be attracted by said attracting portion owing to a magnetic force of said magnet, and
wherein said control device is configured to control said moving portion such that said attracting portion is moved along said ink supply conduit from a position opposed to said first position, in a direction toward said recording head, for thereby moving said movable body from said first position to said second position.

9. The inkjet recording apparatus according to claim 1,
wherein said moving device includes an attracting portion and a moving portion configured to move said attracting portion;
wherein at least one of said movable body and said attracting portion is at least partially made of a magnet,
wherein said attracting portion is disposed in proximity to said ink supply conduit such that said movable body disposed in said ink supply conduit can be attracted by said attracting portion owing to a magnetic force of said magnet, and
wherein said control device is configured to control said moving portion such that said attracting portion is moved along said ink supply conduit from a position opposed to said second position, in a direction toward said ink supply source, for thereby moving said movable body from said second position to said first position.

10. The inkjet recording apparatus according to claim 1, wherein said moving device includes an elastic body which is disposed in one of opposite sides of said movable body, and which is elastically deformable when said movable body is being positioned in said second position, such that said movable body can be moved, owing to a restoring force of said elastic body, from said second position to said first position.

11. The inkjet recording apparatus according to claim 1,
wherein said movable body has a specific gravity that is larger than a specific gravity of the ink, and
wherein said movable body is moved from said first position to said second position in a direction that includes a component parallel to an upright direction.

12. The inkjet recording apparatus according to claim 1, wherein said movable body is a spherical body.

13. The inkjet recording apparatus according to claim 1, further comprising a sealing member which is to be interposed between said inner surface of said ink supply conduit and an outer surface of said movable body when said movable body is being positioned in said second position, such that a fluid tightness between said inner surface of said ink supply conduit and said outer surface of said movable body is established by said sealing member.

14. The inkjet recording apparatus according to claim 1, wherein said control device is configured to control said moving device such that said movable body is moved from said first position to said second position, whereby the ink is forced to be ejected through said recording head.

15. The inkjet recording apparatus according to claim 2,
wherein said control device is configured, when the ink is required to be supplied to said recording head by a predetermined amount, to cause said movable body to be moved from said first position to said second position, whereby the ink within said reduced-clearance defining portion is caused to flow toward said recording head, and
wherein said control device is configured, when the ink is to be required to be supplied to said recording head by a larger amount larger than the predetermined amount, to cause said movable body to be positioned in said third position, so as to allow the ink to be supplied from said ink supply source to said recording head via said larger-clearance defining portion.

16. The inkjet recording apparatus according to claim 15, further comprising an ink return conduit configured to return the ink from said recording head to said ink supply conduit,
wherein said control device is configured, when the ink is to be returned from said recording head to said ink supply conduit via said ink return conduit, to cause said movable body to be positioned in said third position, so as to allow the ink to be supplied from said ink supply source to said recording head via said larger-clearance defining portion.

17. The inkjet recording apparatus according to claim 2, wherein said control device is configured, when the ink is to be forced to be ejected through said recording head by a larger amount larger than an amount of the ink within said reduced-clearance defining portion, to cause said movable body to be positioned in said third position, so as to allow the ink to be supplied from said ink supply source to said recording head via said larger-clearance defining portion.

18. The inkjet recording apparatus according to claim 5, wherein said control device is configured, when the ink is required to be supplied to said recording head by a predetermined amount, to cause said bypass conduit to be closed by said valve, and to cause said movable body to be moved from said first position to said second position, whereby the ink within said reduced-clearance defining portion is caused to flow toward said recording head, and wherein said control device is configured, when the ink is to be required to be supplied to said recording head by a larger amount larger than the predetermined amount, to cause said bypass conduit to be opened by said valve, so as to allow the ink to be supplied from said ink supply source to said recording head via said bypass conduit.

19. The inkjet recording apparatus according to claim 18, further comprising an ink return conduit configured to return the ink from said recording head to said ink supply conduit, wherein said control device is configured, when the ink is returned from said recording head to said ink supply conduit via said ink return conduit, to cause said bypass conduit to be opened by said valve, so as to allow the ink to be supplied from said ink supply source to said recording head via said bypass conduit.

20. The inkjet recording apparatus according to claim 5, wherein said control device is configured, when the ink is to be forced to be ejected through said recording head by a larger amount larger than an amount of the ink within said reduced-clearance defining portion, to cause said bypass conduit to be opened by said valve, so as to allow the ink to be supplied from said ink supply source to said recording head via said bypass conduit.

21. The inkjet recording apparatus according to claim 2, wherein said ink supply conduit includes, in addition to said reduced-clearance defining portion, a downstream side portion that interconnects said reduced-clearance defining portion and said recording head, and wherein said reduced-clearance defining portion includes an upper end portion which is located on a downstream side of said second position in said ink supplying direction and which is connected to said downstream side portion.

22. The inkjet recording apparatus according to claim 21, wherein said reduced-clearance defining portion extends in a vertical direction, such that said second position is located on an upper side of said first position.

23. The inkjet recording apparatus according to claim 21, wherein said moving device that is configured to move said movable body as a first movable body includes a second movable body which is disposed in said ink supply conduit and which is located on an upstream side of said first movable body in said ink supplying direction, such that said first movable body can be pushed by said second movable body in a direction toward said recording head, wherein said moving device includes an attracting portion and a moving portion configured to move said attracting portion;

wherein at least one of said second movable body and said attracting portion of said moving device is at least partially made of a magnet, wherein said attracting portion of said moving device is disposed in proximity to said ink supply conduit such that said second movable body disposed in said ink supply conduit can be attracted by said attracting portion of said moving device owing to a magnetic force of said magnet, and wherein said control device is configured to control said moving portion such that said attracting portion is moved along said ink supply conduit in a direction toward said recording head away from said ink supply source, for thereby moving said second movable body in said direction toward said recording head and moving said first movable body from said third position to said first position.

24. The inkjet recording apparatus according to claim 23, wherein said first movable body and said second movable body are connected to each other via a flexible cord such that said first movable body can be pulled by said second movable body in a direction toward said ink supply source, and wherein said control device is configured to control said moving portion such that said attracting portion is moved along said ink supply conduit in said direction toward said ink supply source, beyond a position opposed to said first position away from said recording head, for thereby moving said second movable body in said direction toward said ink supply source and moving said first movable body from said second position to said first position.

25. The inkjet recording apparatus according to claim 23, wherein said second movable body is smaller than said first movable body.

26. The inkjet recording apparatus according to claim 23, wherein said moving device includes a pump, wherein said first movable body is made of a non-magnetic material, and wherein said control device is configured to control said pump of said moving device such that said first movable body is moved, by activation of said pump, from said first position to said second position.

27. The inkjet recording apparatus according to claim 2, wherein said control device is configured to control said moving device such that said movable body is oscillated in directions toward said recording head and toward said ink supply source when said movable body is being positioned in said third position.

28. The inkjet recording apparatus according to claim 27, wherein said moving device includes an attracting portion and a moving portion configured to move said attracting portion;

wherein at least one of said movable body and said attracting portion is at least partially made of a magnet, wherein said attracting portion is disposed in proximity to said ink supply conduit such that said movable body disposed in said ink supply conduit can be attracted by said attracting portion owing to a magnetic force of said magnet, and wherein said control device is configured to control said moving portion such that said attracting portion is positioned in a position opposed to said third position and is then moved along said ink supply conduit in said directions toward said recording head and toward said ink supply source, for thereby oscillating said movable body in said directions toward said recording head and toward said ink supply source.

29. The inkjet recording apparatus according to claim 3, wherein said ink supply conduit defines an ink channel space that is surrounded by said inner surface of said ink supply conduit, and has a downwardly convex portion in which said ink channel space is downwardly convex, wherein said third position is located in said downwardly convex portion which is located on an upstream side of said reduced clearance defining portion in said ink supplying direction, and wherein said control device is configured to control said moving device such that said movable body is moved back from said reduced-clearance defining portion to said third position after the ink has been stored in said downwardly convex portion.

30. The inkjet recording apparatus according to claim 1, wherein said ink supply conduit defines an ink channel space that is surrounded by said inner surface of said ink supply conduit, and includes a tapered portion in which said inner surface is tapered such that a cross sectional area of said ink channel space is reduced in said ink supplying direction, and wherein said tapered portion is located on a downstream side of said reduced-clearance defining portion in said ink supplying direction.

* * * * *